US006270202B1

(12) United States Patent
Namba et al.

(10) Patent No.: US 6,270,202 B1
(45) **Date of Patent: *Aug. 7, 2001**

(54) LIQUID JETTING APPARATUS HAVING A PIEZOELECTRIC DRIVE ELEMENT DIRECTLY BONDED TO A CASING

(75) Inventors: Akihiko Namba; Yoshihiro Tomita, both of Osaka; Tetsuyoshi Ogura, Settsu; Osamu Kawasaki, Kyotanabe; Masato Sugimoto, Moriguchi; Katsumi Imada; Atsushi Komatsu, both of Katano; Kazuo Eda, Nara, all of (JP)

(73) Assignee: Matsushita Electric Industrial Co., Ltd., Osaka-Fu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/064,848

(22) Filed: Apr. 23, 1998

(30) Foreign Application Priority Data

Apr. 24, 1997 (JP) ..... 9-107466

(51) Int. Cl.[7] ..... B41J 2/045
(52) U.S. Cl. ..... 347/68; 310/330; 310/332
(58) Field of Search ..... 347/68, 54, 71, 347/20; 310/331, 330, 332

(56) References Cited

U.S. PATENT DOCUMENTS

| | | | | |
|---|---|---|---|---|
| 4,358,781 | * | 11/1982 | Yamamori et al. | 347/68 X |
| 4,383,264 | * | 5/1983 | Lewis | 347/68 |
| 4,409,601 | * | 10/1983 | Nilsson et al. | 347/68 |
| 4,438,441 | * | 3/1984 | Bolmgren et al. | 347/68 |
| 4,564,851 | * | 1/1986 | Nilsson et al. | 347/68 |
| 4,998,120 | * | 3/1991 | Koto et al. | 347/70 |
| 5,446,484 | * | 8/1995 | Hoisington et al. | 347/68 |
| 5,666,141 | * | 9/1997 | Matuba et al. | 347/68 X |
| 5,988,799 | * | 11/1999 | Abe et al. | 347/68 |
| 5,992,978 | * | 11/1999 | Fujii et al. | 347/54 |

FOREIGN PATENT DOCUMENTS

| | | | | |
|---|---|---|---|---|
| 0591918 | | 4/1994 | (EP) . | |
| 0768532 | | 4/1997 | (EP) . | |
| 52-10975 | * | 1/1977 | (JP) | 310/332 |
| 59-19383 | * | 1/1984 | (JP) | 310/332 |
| 59-228782 | * | 12/1984 | (JP) | 310/332 |
| 60-87423 | * | 5/1985 | (JP) | 310/332 |
| 4-263951 | * | 9/1992 | (JP) . | |
| 5301342 | | 11/1993 | (JP) | B41J/2/045 |
| 6023986 | | 2/1994 | (JP) | B41J/2/045 |
| 6031914 | | 2/1994 | (JP) | B41J/2/045 |
| 6071894 | | 3/1994 | (JP) | B41J/2/16 |
| 6087217 | | 3/1994 | (JP) | B41J/2/16 |
| 6134983 | | 5/1994 | (JP) | B41J/2/045 |
| 9094965 | | 4/1997 | (JP) | B41J/2/16 |

* cited by examiner

*Primary Examiner*—Benjamin R. Fuller
*Assistant Examiner*—C Dickens
(74) *Attorney, Agent, or Firm*—Wenderoth, Lind & Ponack, L.L.P.

(57) ABSTRACT

A liquid jetting apparatus has a concave casing having an opened flat face, and a piezoelectric drive element for at least partly sealing the opened flat face to form a liquid reservoir to store a liquid, such as ink. The reservoir has a liquid injection port for injecting a liquid and a liquid jet port for jetting the stored liquid. The piezoelectric drive element is directly bonded to the open flat face.

19 Claims, 19 Drawing Sheets

LIQUID JETTING APPARATUS HAVING A PIEZOELECTRIC DRIVE ELEMENT DIRECTLY BONDED TO A CASING

BACKGROUND OF THE INVENTION

1. Field of the Invention

The present invention relates to a liquid jetting apparatus for intermittently jetting fine liquid particles, such as is typically seen in ink jet printer heads, and also to a method for making the liquid jetting apparatus.

2. Description of the Related Art

The proliferation of the ink jet printer, as a printer which can implement color printing at low cost, has developed rapidly in recent years. The performance of such ink jet printers is determined by the printer head, which comprises a liquid jetting apparatus that intermittently jets fine liquid particles. There is a demand for ink jet printers that can perform high-resolution printing, multi-gradation printing, and high-speed printing at low cost.

In order to achieve high-resolution printing, the ink particle size for each dot must be made small (small dot diameter). This means that it is necessary to precision-machine the jet tip units that jet the ink. In order to print at 600 dpi, for instance, the dot diameter must be made 40$\mu$ or smaller, making it necessary to precision-machine the jet tips to 40$\mu$ or smaller.

In order to achieve multi-gradation printing, the following properties are required in the liquid jetting apparatus. Firstly, the ink particle size and shape must be precisely controlled (dot control). This means that it is necessary to jet the ink with good controllability, that is, to stably jet the requisite amount of ink, using stable jetting means. This must be explained in greater detail. In general, two types of gradation control are employed, namely area modulation and dot modulation. Area modulation is a method of expressing different shades by thinning out the dots being recorded, that is, by lowering the dot recording density. Substantially, then, this is not really high-resolution, multi-gradation printing. Dot modulation, on the other hand, is a method of expressing different shades by altering the quantity of ink being jetted. In order to realize 16-gradation printing in one color using dot modulation, for example, the ink volume must be controlled to within about 5%. Currently, however, due to the difficulty of jetting ink with good controllability, only 2 to 4 gradations per dot can be achieved, which is very low.

In order to realize high-speed printing, the following performance is required in the liquid jetting apparatus. To begin with, it must be possible to jet the ink intermittently in a short time interval. Printing one A4 page at 600 dpi, for example, requires between 30 and 40 million dots. If this is to be done in 1 minute, requiring printing at the speed of 500,000 dots per second or higher, the liquid jetting apparatus must be capable of intermittent jetting at the high speed of 30 million dots per minute or faster. Secondly, many liquid jet nozzles must be lined up abreast of each other (multiple nozzle implementation). In order to effect multiple nozzle implementation, one must machine and align the nozzles with high precision, while keeping costs from getting out of hand and preventing the elements from becoming too large.

Apparatuses that jet ink and other liquids with good precision are used not only in ink jet printers but also in production lines for marking or illustrating industrial products, for liquid drug coating, and other applications. Thus high-speed high-precision liquid jetting apparatuses are also demanded in other fields.

A representative example of an ink jet printer head will now be described as a conventional liquid jetting apparatus. Ink jet printer heads can be broadly classified into thermal heads and piezoelectric heads. The principle of the thermal head is explained first, with reference to FIG. 22. FIG. 22 is a cross-sectional view of the head unit. An ink reservoir 803 is sandwiched into the space between a plate 801 and a plate 802, and a heater 804 is provided between the ink reservoir 803 and the plate 801. Ink is supplied naturally from the supply side (ink injection port 805) of the ink reservoir by capillary action. By passing a current through the heater 804, the ink is quick-boiled, whereupon the ink at the tip is jetted out from the jet nozzle 806.

An example of a piezoelectric ink jet printer head is now described with reference to FIG. 23, which is a cross-sectional view of such a head. Item 811 is a monomorph piezoelectric drive element which is comprised of a stationary plate 813 and a piezoelectric ceramic material 812 provided with electrodes on its upper and lower surfaces. An ink flow path (reservoir) 818, ink injection port 815, and ink jet nozzle 816 are formed by laminating a bonding medium 817 onto a plate 814. The method of forming the monomorph piezoelectric drive element 811 is to print and bake on electrodes consisting of laminated sintered bodies made of zirconia, then print and bake thereon a paste of lead zirconate titanate (PZT) to provide the piezoelectric ceramic, and finally to print and bake thereon an upper electrode. The flow path (reservoir) unit is made by laminating and bonding three layers of a metal sheet with intervening resin bonding films in a structure that provides both a nozzle and an ink supply flow path. The ink is supplied by capillary action through the ink flow path provided in the nozzle unit to the ink drive unit and nozzle unit. Ink jetting is effected from the jet aperture 816 by the ink in the ink flow path unit (reservoir) being put under pressure by the monomorph piezoelectric drive element. To facilitate high-speed printing, the actual head structure has a plurality of the elements described above arranged in a line.

With the conventional thermal and piezoelectric liquid jetting apparatuses, however, the following problems are encountered when seeking to implement high-resolution, multi-gradation, high-speed printing at low cost.

The conventional thermal liquid jetting apparatus has a simple structure which affords the advantage of low-cost production. However, because liquid quick-boiling is utilized to jet the liquid, it is extremely difficult to control both the volume of liquid vaporized and the volume of liquid jetted during the printing of one dot, rendering high-resolution, multi-gradation printing very problematic. Also, heating and cooling are repeated every time the liquid is jetted, so that time is required to raise and lower the temperature of the heater by amounts corresponding to the heat capacity of the gas or liquid that support the heater. Thus high-speed printing is very difficult. Furthermore, since heating and cooling are repeated at high speed, the base unit and heater are damaged by thermal shock, resulting in short useful life.

The piezoelectric liquid jetting apparatus, on the other hand, uses a piezoelectric drive element to push out the liquid. Compared to the thermal type, it can make instantaneous deformations, shorten the time required for repeated liquid jetting, and facilitates jet volume control. However, in order to jet finer liquid particles and to accurately control jet volume, the liquid reservoir and nozzle units have to be formed with a precision commensurable with the desired particle diameter, the piezoelectric drive must be highly controllable, and reproducibility must be good. In conventional piezoelectric liquid jetting apparatuses, holes for the flow path are made in zirconia green sheets, and these sheets are laminated to form the flow paths, making it very difficult to form flow paths of very high precision. But the problems are not limited to the precision with which holes can be made. The flow path shape is deformed in the press during the lamination process, and contraction and flexure occur during the baking process. In forming the monomorph piezoelectric drive elements, moreover, a different piezoelectric ceramic than the flow path material is laminated and baked at high temperature, so the deformation is even greater. The larger the area affected by these baking deformations, the greater the error, making it very difficult to achieve dimensional precision in inter-nozzle pitch, etc., when implementing multiple nozzles to handle high-speed printing. This limits the area which can be handled, and the number of nozzles that can be implemented. Also, when the piezoelectric drive units, liquid reservoirs, and jet units are made as separate components, and bonded together with resin film, faulty positioning, the thickness of the bonding layers, and irregularities in the bonding condition result in subtle differences in the conditions of the flow paths and, hence, in variation in jet volume. Making the piezoelectric drive units, liquid reservoirs, and jet units as separate components requires high-precision positioning, making assembly operations difficult, and leading to higher assembly costs.

In addition, piezoelectric ceramics exhibit non-linear drive characteristics relative to the applied voltage, making high-precision control difficult. Furthermore, since hysteresis is exhibited, variations in jet volume occur, depending on pulse history. In addition, because the material used has a Curie point of about 300°, at which polarization processing is easy, the polarization state gradually changes during operation due to auto-exothermic behavior and the effects of the applied voltage. When multiple nozzles are implemented, the characteristics of their respective piezoelectric elements will exhibit variation depending on their composition, sintering conditions, and polarization process conditions.

In the liquid jetting apparatus, moreover, the volume of liquid that must be pressed out in one jetting is the combined capacity of the piezoelectric drive unit and the liquid reservoir (including nozzle unit). In cases where it is difficult to achieve finer implementation, as with the prior art, a large volume of liquid must be pressed out, compared to the volume of the minute liquid particles that it is desired to jet, making high-speed intermittent jetting very difficult.

The present invention resolves the problems described in the foregoing. It achieves high-resolution printing by reducing the size of the liquid particles jetted to the micron order (smaller dot diameters) and by precisely controlling liquid jet volume (dot diameter control). It also achieves multi-gradation printing by enhancing the reproducibility of liquid jet volume (dot reproducibility) and by precision dot diameter control. In addition, it achieves a high-speed printing by jetting liquid intermittently at short time intervals (high-speed jetting) and by increasing the number of nozzles provided in the apparatus (multiple nozzle implementation). An object of the present invention, moreover, is to provide an inexpensive liquid jetting apparatus that exhibits these features together with long useful life. By employing the liquid jetting apparatus of the present invention, high-resolution, multi-gradation, high-speed printing can be realized at low cost.

SUMMARY OF THE INVENTION

According to the present invention, a liquid jetting apparatus comprises: a concave casing having an opened flat face; and a piezoelectric drive element for at least partly sealing the opened flat face to form a liquid reservoir to store a liquid. The reservoir has a liquid injection port for injecting a liquid and a liquid jet port for jetting the stored liquid, and the piezoelectric drive element is directly bonded to the open flat face.

According to the present invention, a liquid jetting apparatus comprises: a concave casing having a bottom plate and an opened flat face; a supporting plate directly bonded to the flat face to form a liquid reservoir, with the reservoir having a liquid injection port for injecting a liquid and a liquid jet port for jetting the stored liquid; and a piezoelectric drive element bonded to the bottom plate.

According to the present invention, a method for making a liquid jetting apparatus comprises: mirror finishing a concave casing at an opened flat face; mirror finishing a piezoelectric drive element at one flat face; and placing the one flat face of the piezoelectric drive element on the opened flat face to at least partly cover the opened flat face so as to effect direct bonding between the opened flat face and the one flat face.

According to the present invention, a method for making a liquid jetting apparatus comprises: mirror finishing a concave casing at an opened flat face, where the concave casing has a bottom plate; mirror finishing a supporting plate at one flat face; placing the opened flat face of the concave casing on the one flat face of the supporting plate to cover the opened flat face so as to effect direct bonding between the opened flat face and the one flat face; and bonding a piezoelectric drive element to the bottom plate.

BRIEF DESCRIPTION OF THE DRAWINGS

FIGS. 5(*c*) and 5(*d*) are diagrams showing polarization direction in three dimensional space;

DESCRIPTION OF THE PREFERRED EMBODIMENTS

First Embodiment

Figure 1A:
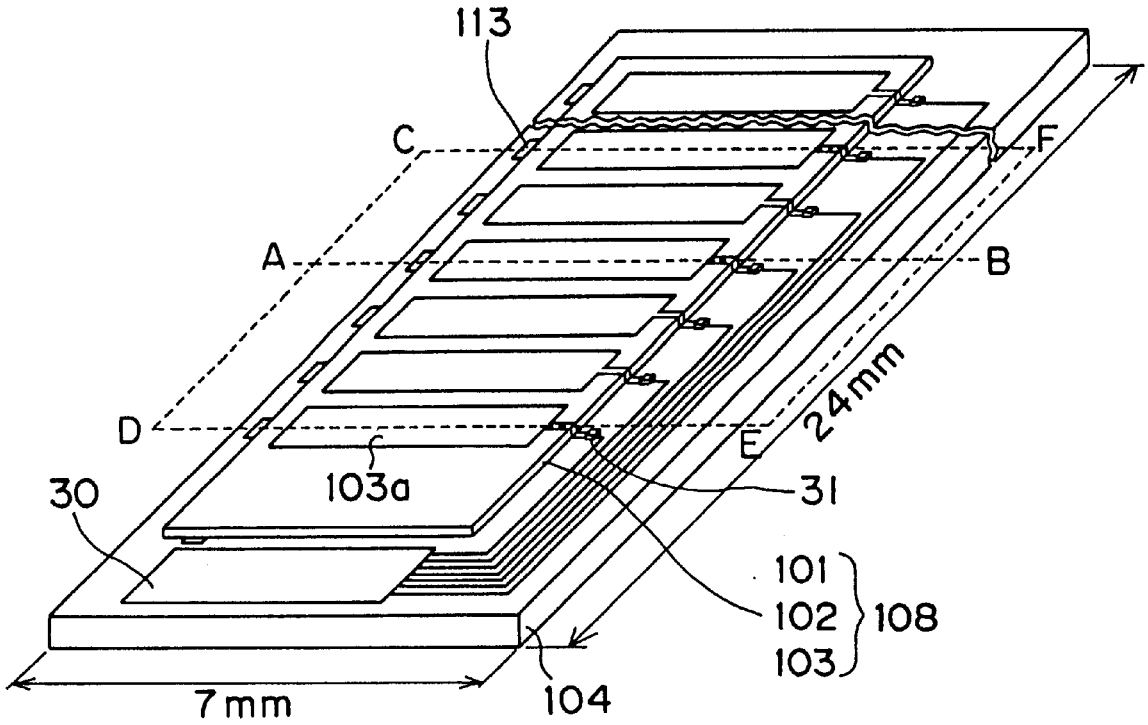
FIGS. 1(*a*) and 1(*b*) are a perspective views of a liquid jetting apparatus in a first embodiment of the present invention, and a perspective view of a silicon plate, respectively.
Figure 1B:
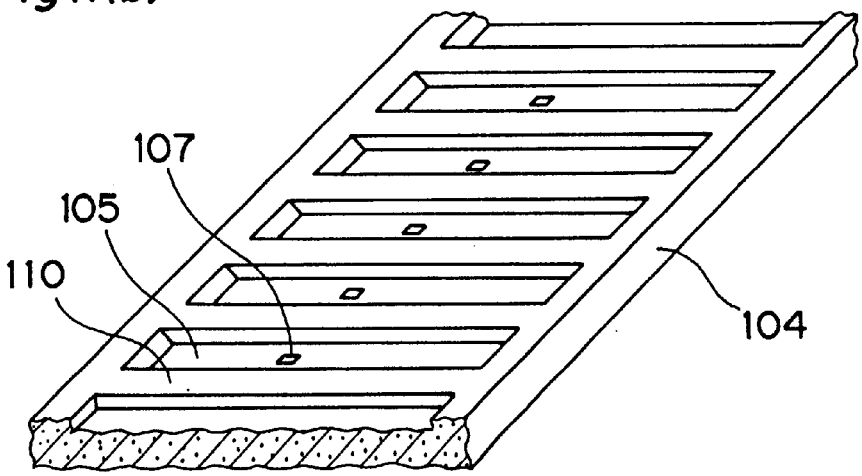
Figure 2A:
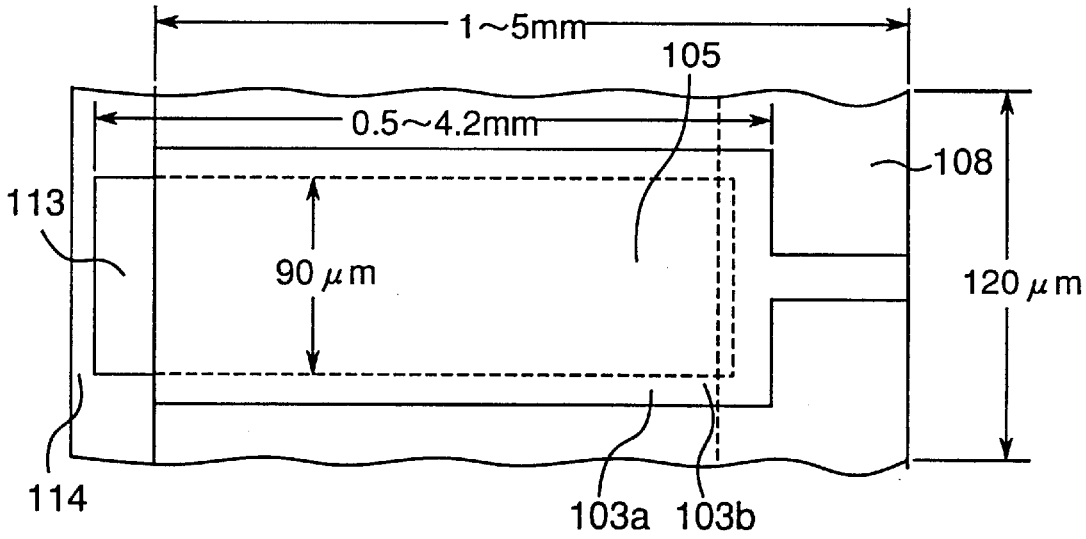
FIGS. 2(*a*), 2(*b*) and 2(*c*) are a plan view, a cross-sectional view, and a bottom view, respectively, of one element of the liquid jetting apparatus of the first embodiment.
Figure 2B:
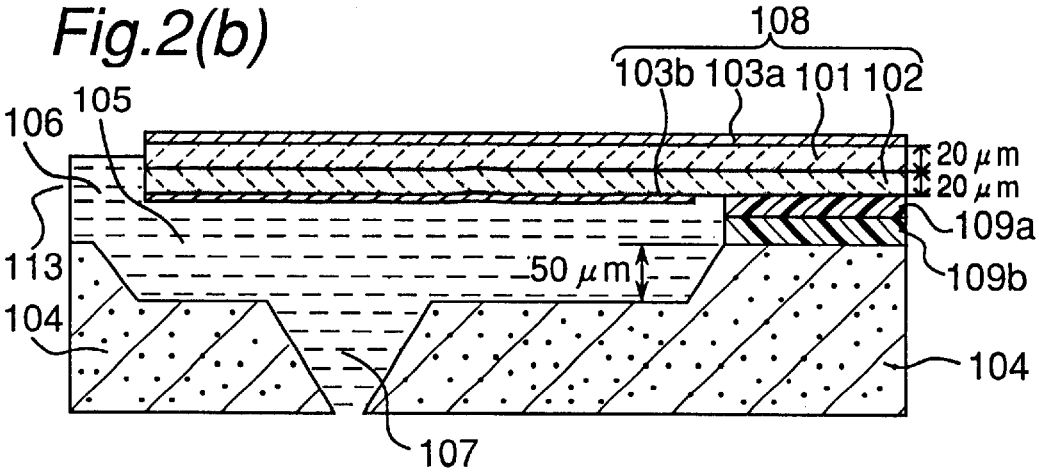
Figure 2C:
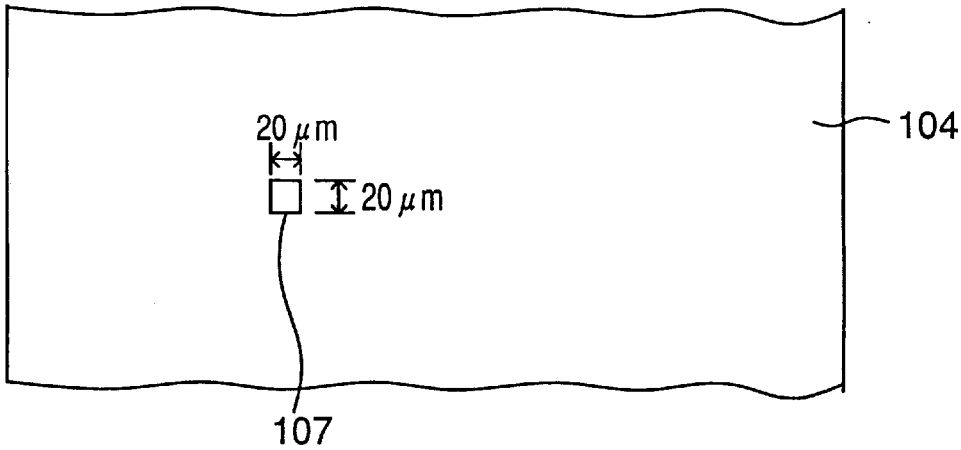

A first embodiment of the liquid jetting apparatus of the present invention will now be described, making reference to FIG. 1. FIGS. 1(*a*) and (*b*) are diagrams representing the structure of the liquid jetting apparatus of this embodiment, (a) being a diagonal view of the liquid jetting apparatus, and (b) being a diagonal view of only the silicon plate in the region bounded by a broken-line rectangle with corners at points C, D, E, and F. FIG. 2 provides views of only one element in the liquid jetting apparatus of FIG. 1, (a) in FIG. 2 being a plan, (b) a cross-sectional view in the A-B plane in FIG. 1, and, (c) being a bottom view.

In FIGS. 1 and 2, items 101 and 102 are piezoelectric plates, which may, for example, be monocrystalline lithium niobate plates. Items 103*a* and 103*b* are laminated titanium and/or gold electrodes provided at prescribed places in the monocrystalline lithium niobate plates 101 and 102. Item 108 is a bimorph element (piezoelectric drive element) formed of the monocrystalline lithium niobate plates 101 and 102, and the electrodes 103. Item 104 is a plate and defines a concave casing for holding the bimorph element 108, as well as for storing and jetting ink 106. Item 105 is a liquid reservoir or a void for storing the ink 106, provided in the silicon plate 104. Item 107 is a holes or a jet port for jetting the ink, Item 109 is a film resist, And item 113 is an ink injection port.

The dimensions of the liquid jetting apparatus in this embodiment will now be described. The size of the liquid jetting apparatus in FIG. 1 is 24 mm on the long side (being the width dimension of the piezoelectric element, parallel to the line C-D) is 24 mm, and on the short side (the longitudinal dimension of the piezoelectric element) is 7 mm. In FIG. 2, the size of each of the monocrystalline lithium niobate plates 101 and 102 is 120$\mu$ in the vertical direction (width dimension), 1 to 5 mm in the horizontal direction (longitudinal dimension), and 20$\mu$ in thickness direction. The aperture of the void 105 of the silicon plate 104, looking from above, is 90$\mu$ in the vertical direction, and 4.2 mm in the horizontal direction (cf. FIG. 2(*a*)). The depth of the void 105 in the silicon plate 104, excluding the jet port 107, is 50$\mu$. The aperture of the jet port 107, looking from below, is 20$\mu$ in both the vertical and horizontal (cf. FIG. 2(*c*)).

Next, the structure of the piezoelectric drive plate in the liquid jetting apparatus of this embodiment is described, making reference to FIG. 5. The monocrystalline lithium niobate plates 101 and 102 are polarized in opposite directions in the thickness dimension, as diagrammed in FIG. 5(*a*). Ordinarily, monocrystalline lithium niobate is polarized in the Z-axis dimension of the crystal, that is, in the direction of the z axis. As diagrammed in FIG. 5(*c*), the monocrystalline lithium niobate plates 101 and 102 are plates that have been cut so that the y axis is turned 140 degrees about the x axis, taken as a turning axis, to form a new axis y'. Simultaneously, the z axis is also turned 140 degrees to form the axis z', thereupon making the y' axis the normal direction. In other words, the monocrystalline lithium niobate plates 101 and 102 are plates that have been cut as diagrammed in FIG. 5(*d*). When these plates 101 and 102 are bonded together so that their fronts and backs are reversed, a plate is formed having the polarization directionality diagrammed in FIG. 5(*a*). As diagrammed in FIG. 5(*b*), furthermore, the plates may be cut and bonded together so that the polarity directions are not completely opposite, but rather subtend an angle of 80 degrees.

In this embodiment, the lithium niobate plates 101 and 102 are cut from an ingot polarized in the prescribed direction, at the cutting angle described above, then directly bonded together in a process that is described below. After the bonding, the electrodes 103*a* and 103*b* are formed on the upper and lower surface thereof. When a pulsing voltage is applied to the lithium niobate plates 101 and 102, in the plate thickness direction thereof, they exhibit the characteristic of elongating and contracting in the longitudinal dimension of the plate. By bonding them together with their polarities reversed, therefore, if the lithium niobate plate 101 exhibits an elongating displacement, the lithium niobate plate 102 will exhibit a contracting displacement, thus forming a bimorph element 108 that exhibits a flexure displacement. The bimorph element 108 is held to the silicon plate 104 through a resin sheet such as, for example, a film resist. The holding by the film resist is done on three sides of the monocrystalline lithium niobate plate 102 to provide three-sided holding.

Figure 6A:
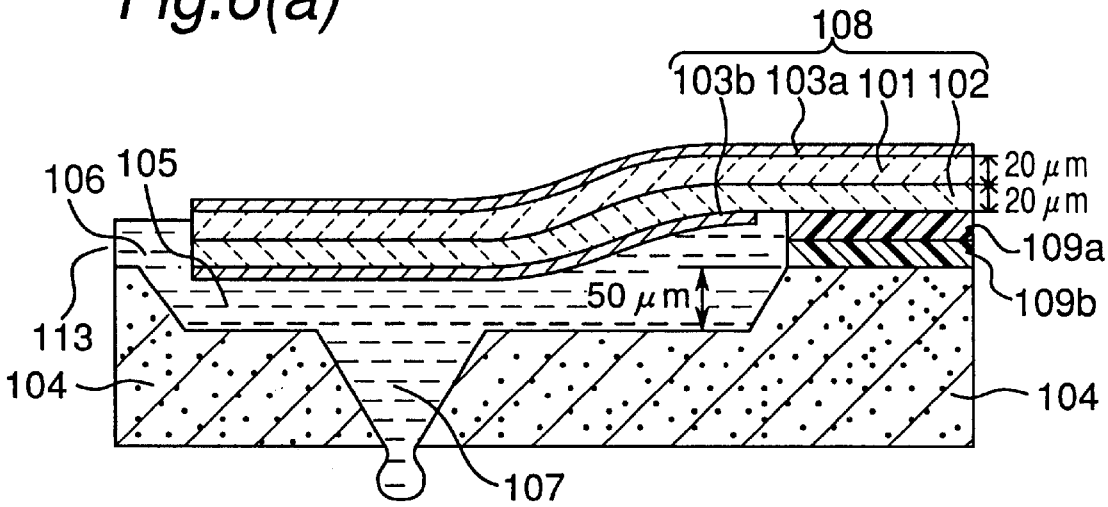
FIGS. 6(*a*) and 6(*b*) are diagrams for explaining the operation of the liquid jetting apparatus of the first embodiment.
Figure 6B:
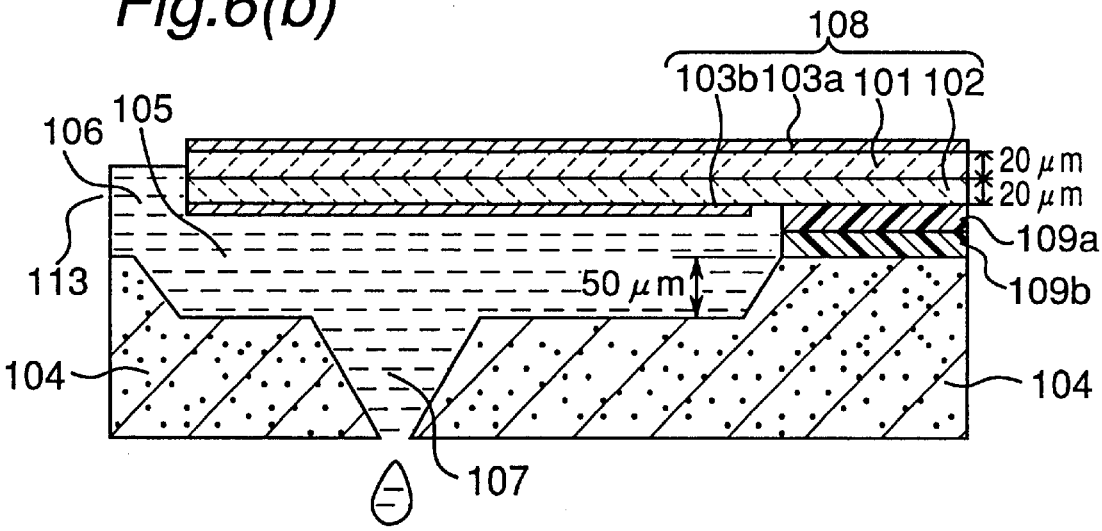

Next, the operational principle of the liquid jetting apparatus of this embodiment is described. Ink is taken into storage in the void 105 by capillary action, and is held there by surface tension. When a pulsing voltage is applied to the electrode 103, the bimorph element exhibits a flexure displacement, and the ink 106 stored in the void 105 is put under pressure. When it is put under pressure, the ink 106 is pushed out from the jet port 107 (FIG. 6(*a*)). When the pulsing voltage stops, the bimorph element returns to its original state, and the ink that has been pushed out is cut off (FIG. 6(*b*)). The force of this pushing out is strong, so the pushed out ink is jetted.

Figure 4A:
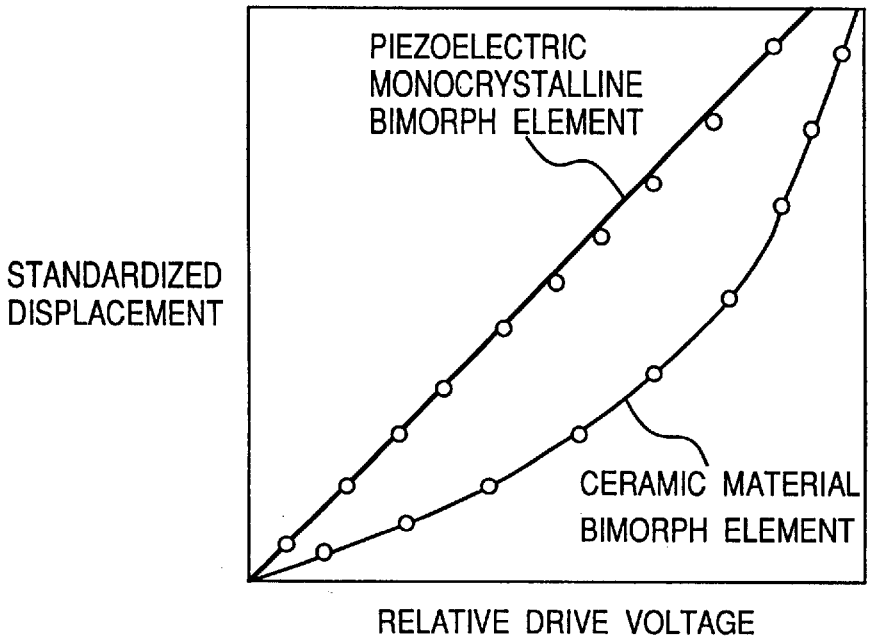
FIGS. 4(*a*) and 4(*b*) are characteristic diagrams for a piezoelectric drive element of the liquid jetting apparatus of the first embodiment.
Figure 4B:
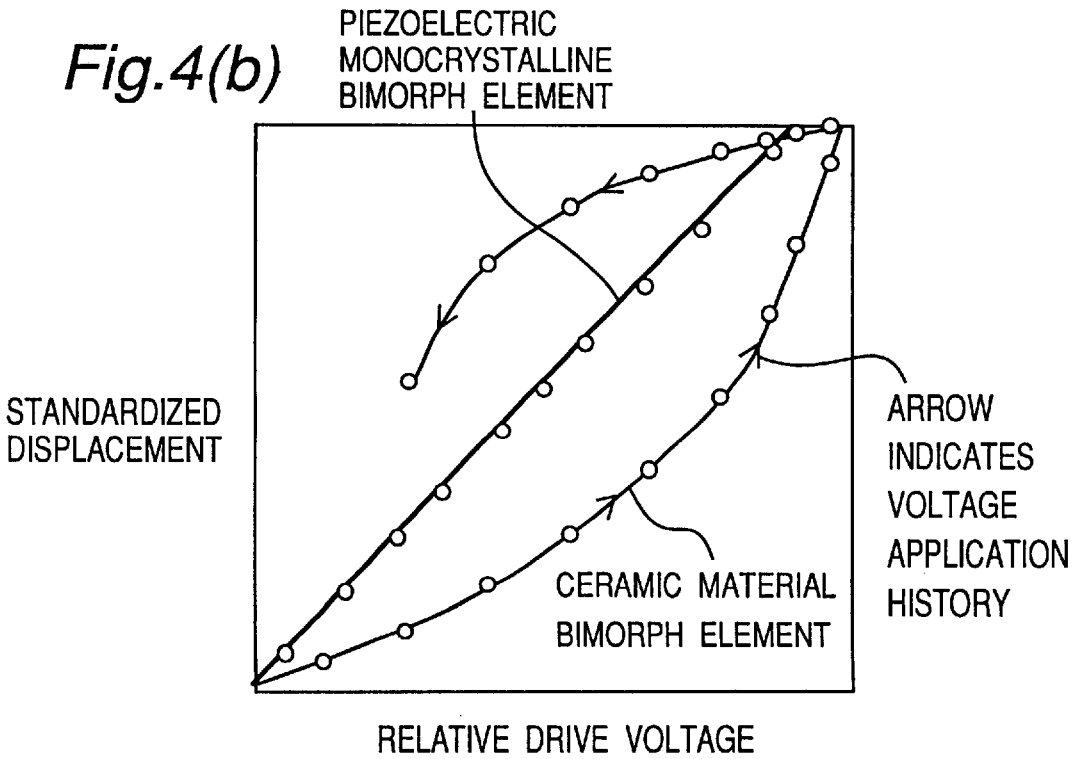
Figure 5A:
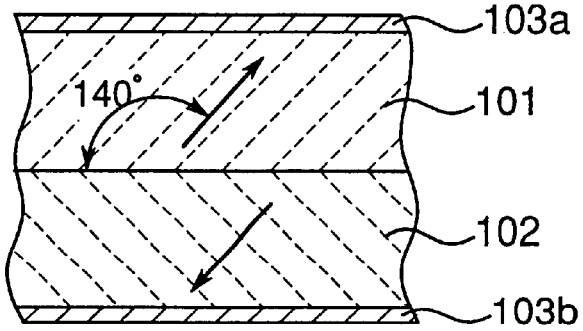
FIGS. 5(*a*) and 5(*b*) are cross-sectional views of the piezoelectric drive element, particularly showing the polarization directions.
Figure 5B:
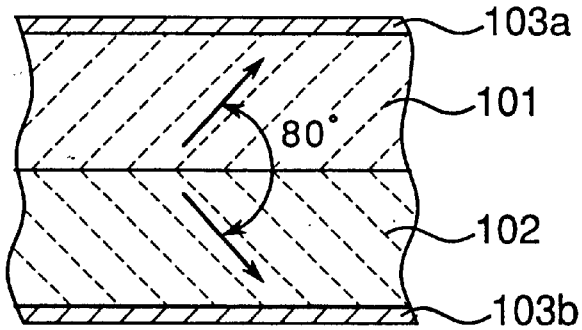
Figure 5C:
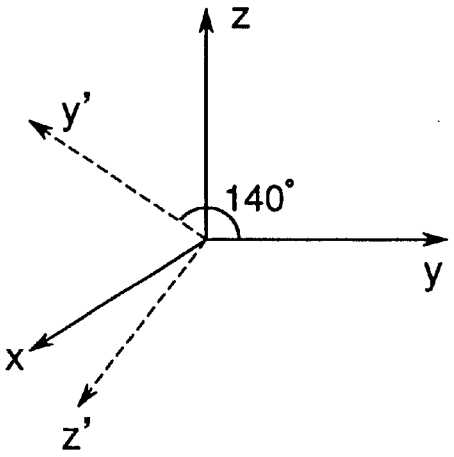
Figure 5D:
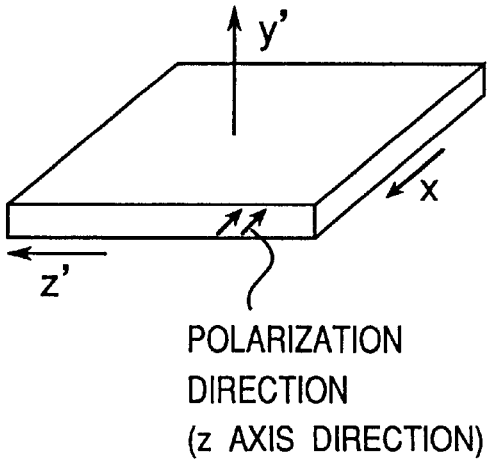

What is characteristic of the liquid jetting apparatus of this embodiment is that a piezoelectric monocrystalline material is used for the piezoelectric members forming the bimorph element 108, and that the monocrystalline lithium niobate plates 101 and 102 forming the bimorph electrode are directly bonded together. FIG. 4(*a*) plots the relationship between standardized displacement and relative drive voltage in the piezoelectric monocrystalline bimorph element of this embodiment and in a ceramic bimorph element made with PZT (lead zirconate titanate). As is evident from this figure, with the piezoelectric monocrystalline bimorph element of this embodiment, the amount of element displacement relative to the drive voltage value, that is, the volume of ink jetted out, changes linearly, resulting in good jet volume controllability (dot controllability).

In FIG. 4(*b*) is plotted the relationship between standardized displacement and relative drive voltage in the piezoelectric monocrystalline bimorph element of this embodiment and in a ceramic bimorph element made with PZT (lead zirconate titanate), together with the voltage application history. As diagrammed here, with the ceramic bimorph element, depending on the drive voltage application history, a phenomenon (hysteresis based on material properties) is exhibited whereby the amount of displacement in the element differs even under the same drive voltage. The characteristic shown in this figure is but one example; various displacement characteristics will be exhibited when the voltage application history is changed. This hysteresis is a phenomenon that occurs because the polarization state of the ceramic material (PZT) is changed by the applied voltage, so that its piezoelectric characteristics are also changed. When a piezoelectric drive element is made using a piezoelectric substance exhibiting such material-property induced hysteresis as this, it becomes exceedingly difficult to control the amount of element displacement with the value of the drive voltage, which means that it is very difficult to control the liquid jet volume.

Hysteresis may also be produced in a completely different way, however, namely by the adhesive. When two PZT plates are bonded together with an adhesive to make a ceramic bimorph element, for example, hysteresis appears in the displacement-drive voltage characteristics due to the effects of the adhesive. A number of causes are conceivable for this hysteresis, the main one of which is now described. When a voltage is applied to a ceramic bimorph element, the element is deformed in the direction of flexure (the displacement becoming larger), which subjects the adhesive to a stress. Even when the drive voltage is changed, this stress becomes a residual stress which affects the displacement characteristics of the element. These forms of hysteresis imipair liquid jet volume reproducibility.

Element characteristics may also be affected by the adhesive in ways other than hysteresis. An adhesive must be applied as thinly as possible in order to minimize elastic energy loss. In practice, however, adhesive thicknesses are in the neighborhood of several microns. It is also very difficult to apply an adhesive at a uniform thickness, and adhesive thickness irregularities become a cause of variation in the characteristics of a piezoelectric drive element. For the reasons cited here, jet volume reproducibility and controllability in a liquid jetting apparatus deteriorate when an adhesive is used in a piezoelectric drive element.

Furthermore, it is possible to build a drive circuit 30 for the piezoelectric drive element (bimorph element 108) on the silicon plate 104, as depicted in FIG. 1. Drive signals are sent from this drive circuit 30 to each of the piezoelectric drive elements, and are conveyed to electrodes 103*a* through gates 31. The other electrode 103*b* is provided more or less over the entire back surface of the piezoelectric drive element and is grounded. There is no need to provide a drive circuit 30 separately, making further miniaturization of the device possible. By building in circuitry to distribute and apply piezoelectric drive element drive control voltages to each of the piezoelectric drive elements, the parallel electric cable used conventionally is rendered unnecessary, thus permitting significant size reduction.

The structure described in the foregoing affords the benefits described below. In the first place, the following benefits are realized by configuring the piezoelectric drive element 108 using plates 101 and 102 that are made of monocrystalline lithium niobate, which is a piezoelectric monocrystal.

The liquid jet volume can be easily controlled (dot controlled) because the element displacement varies linearly with changes in drive voltage, as noted earlier.

By using a monocrystalline material, moreover, in forming the piezoelectric drive elements, there is no hysteresis induced by material properties, and by directly bonding the piezoelectric monocrystalline plates together through direct bonding steps, there is no hysteresis induced by an adhesive. Thus liquid jet volume can be definitely controlled, and liquid jet volume reproducibility is enhanced. By enhancing jet volume reproducibility, it becomes possible to make dot size uniform.

Monocrystalline materials exhibit little variation in material characteristics, either within the same plate, or from one production lot to another. As a result, there is little variation in the characteristics either between one liquid jetting apparatus and another, or within the same liquid jetting apparatus. This means, in other words, that liquid jet volume reproducibility (dot reproducibility) can be raised to a high level, both between apparatuses and between elements.

Unlike ceramic materials, moreover, monocrystalline materials do not have grain boundaries, making it easy to achieve thin sheets with thicknesses on the micron order, and thereby making it possible to achieve large displacements in piezoelectric drive elements. In addition, monocrystalline materials exhibit less degradation in mechanical strength than do ceramic materials. Thus, in cases where the piezoelectric drive elements are subjected to high drive frequencies, the resulting element life decline and element characteristic degradation can be lessened. This makes it possible to implement high-speed jetting using high drive frequencies.

Because the piezoelectric monocrystalline plates are bonded together by direct bonding, which is bonding at the atomic level, there is almost no variation in piezoelectric drive element characteristics due to variation in the bonding condition. As a consequence, greater liquid jet volume reproducibility (dot reproducibility) can be realized, both between apparatuses and between elements. Direct bonding is stable bonding with which there is almost no deterioration over time. Thus variation in characteristics between elements caused by deterioration over time and by characteristic degradation in the piezoelectric drive elements over time can be reduced. Accordingly, jet volume reproducibility (dot reproducibility) can be enhanced without deterioration over time. It also becomes possible to realize large displacements with low drive voltages without suffering energy loss due to an adhesive, which means that greater liquid jet volumes can be obtained. In addition, when subjected to bending or other mechanical shock, there is almost no peeling or other alteration where materials are directly bonded, making it possible to drive elements at high frequencies and to achieve high-speed jetting.

Thanks to the benefits described in the foregoing, dot size controllability can be enhanced, dot reproducibility can be enhanced, and a liquid jetting apparatus can be configured which is capable of high-speed printing, without deterioration over time.

Figure 3:
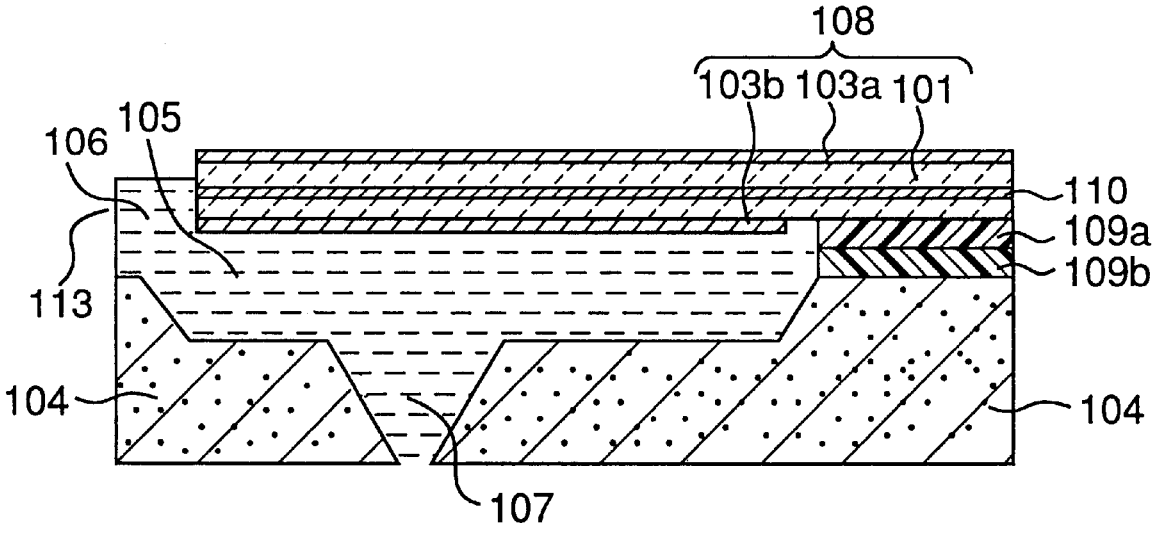
FIG. 3 is a cross-sectional view of a modified form of the liquid jetting apparatus of the first embodiment.

If the monocrystalline lithium niobate plates 101 and 102 are configured with monocrystalline piezoelectric plates, moreover, there is, no absolute necessity of bonding them together by direct bonding, and it is permissible to use an adhesive. As diagrammed in FIG. 3, for example, a polyimide thin film may be used as the adhesive 110 to bond two piezoelectric members, namely the monocrystalline lithium niobate plates 101 and 102, together to form a bimorph element. In a bimorph element having such an adhesive layer, there will be energy loss due to the adhesive layer. In this embodiment, when a structure is employed having a 2–4$\mu$ adhesive layer, there will be a 25–35% energy loss as compared to directly bonded structures.

Also, because silicon is used in the silicon plate 104, the liquid jet ports and liquid reservoirs can be miniaturized with high precision, which is beneficial in terms of enhancing dot reproducibility and implementing multiple nozzles.

Furthermore by using silicon plates with built-in integrated circuits, as described above, it is possible to realize very significant element miniaturization.

Figure 7A:
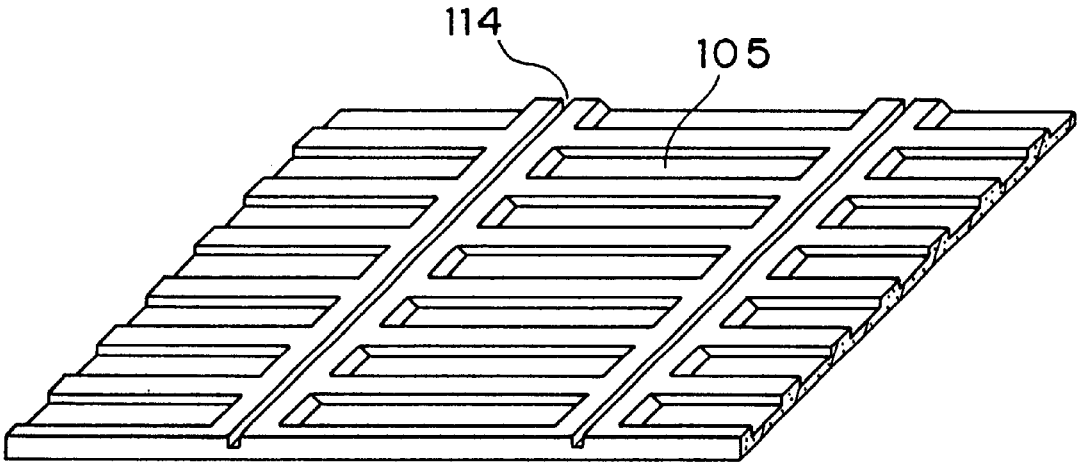
FIGS. 7(*a*), 7(*b*) and 7(*c*) are diagrams showing the steps for making the liquid jetting apparatus of the first embodiment.
Figure 7B:
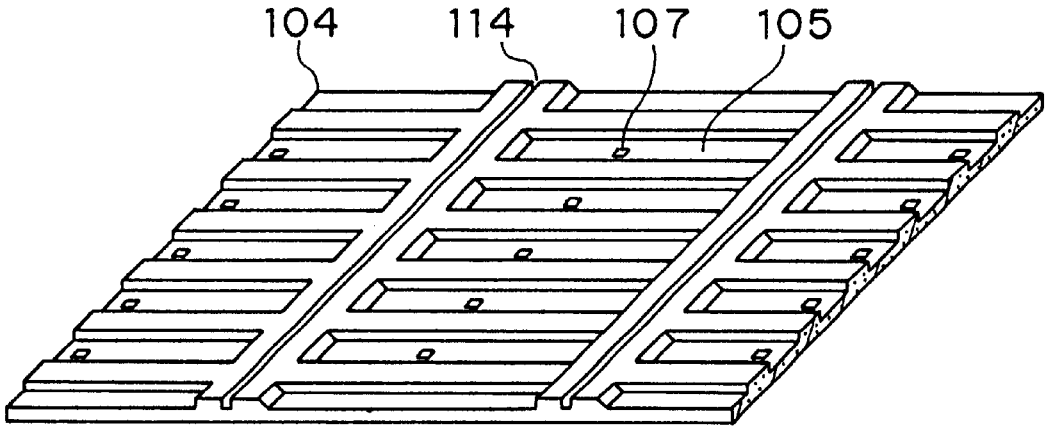
Figure 7C:
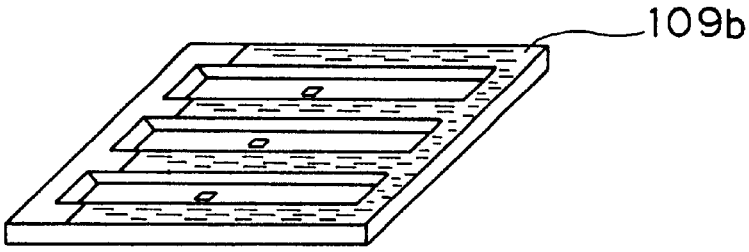
Figure 8A:
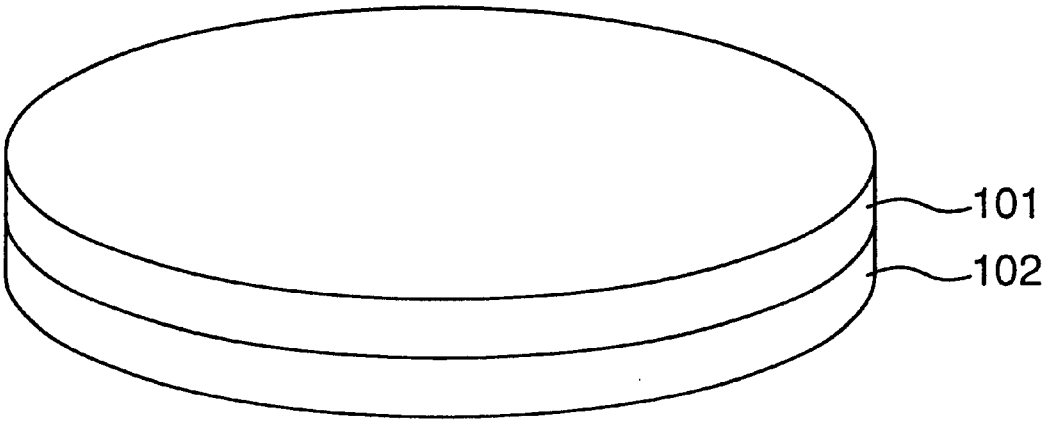
FIGS. 8(*a*) and 8(*b*) are diagrams showing the steps for making the liquid jetting apparatus of the first embodiment.
Figure 8B:
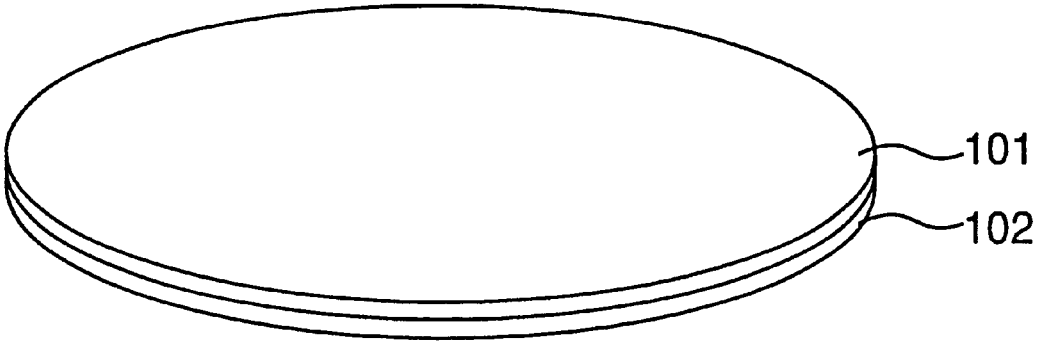

A method of manufacturing the liquid jetting apparatus of this embodiment will now be described, with reference to FIGS. 7 and 8. FIGS. 7(*a*), 7(*b*), and 7(*c*) are enlarged partial diagrams of a silicon plate. FIGS. 8(*a*) and (*b*) are diagrams of a bonded plate comprising the monocrystalline lithium niobate plates 101 and 102, and a plate in which the bonded plates have been made thin sheets.

(Step 1) As diagrammed in FIG. 7(*a*), a silicon oxide etching mask is formed by photolithography on a silicon plate 104 having a (100) crystal plane at the plate surface, and anisotropic etching is performed using hydrazine to form the voids 105. At the same time, dicing lines 114 are formed.

(Step 2) As diagrammed in FIG. 7(*b*), jet ports 107 are formed in the back (bottom) surface of the silicon plate 104 by the same process as in Step 1. Next, as diagrammed in FIG. 7(*c*), a photosensitive film resist is applied by photolithography to those portions that will be bonded to the monocrystalline lithium niobate plate 102. This film resist is later used in Step 5. In order to strengthen the holding strength provided by the film resist, it is best to pre-treat the areas where the film resist is to be applied, by etching or sand blasting to roughen the surface. The same applies to Step 4 which is described below.

Figure 21A:
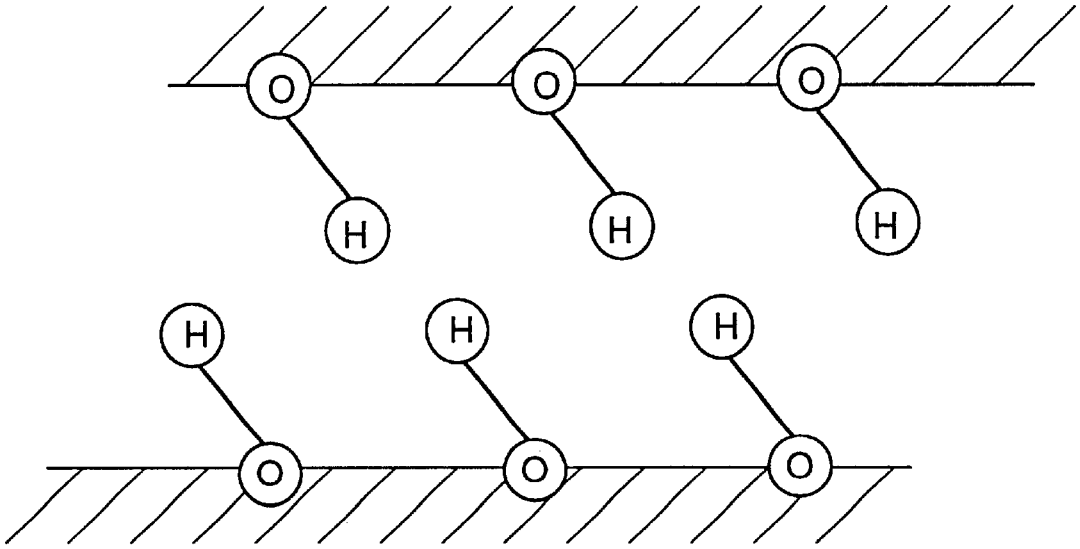
FIGS. 21(*a*), 21(*b*) and 21(*c*) are diagrams for explaining direct bonding.
Figure 21B:
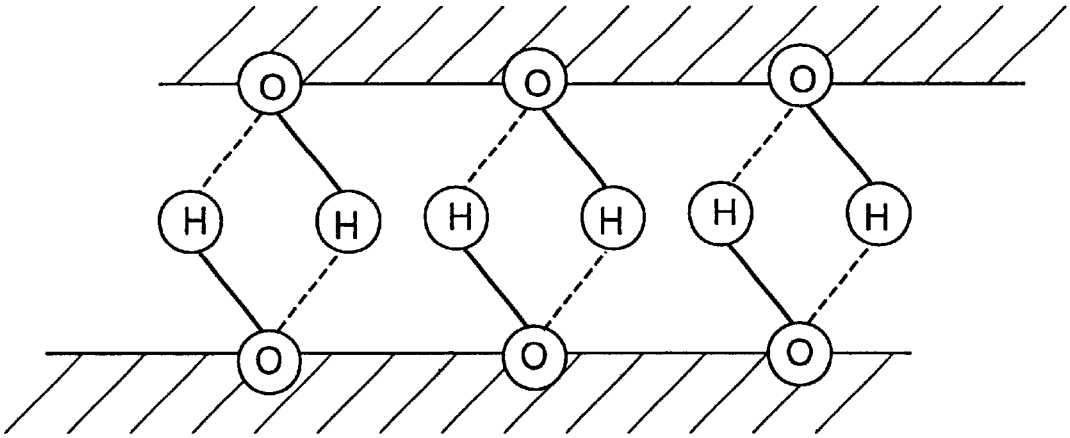
Figure 21C:
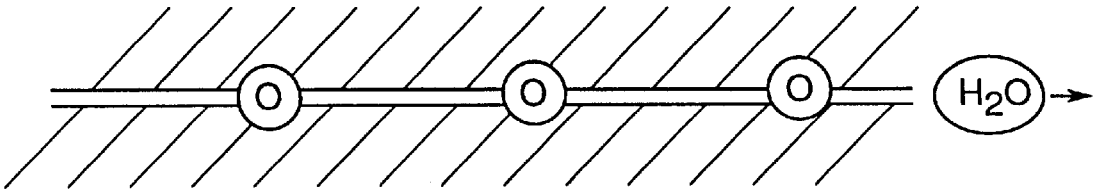
Figure 22:
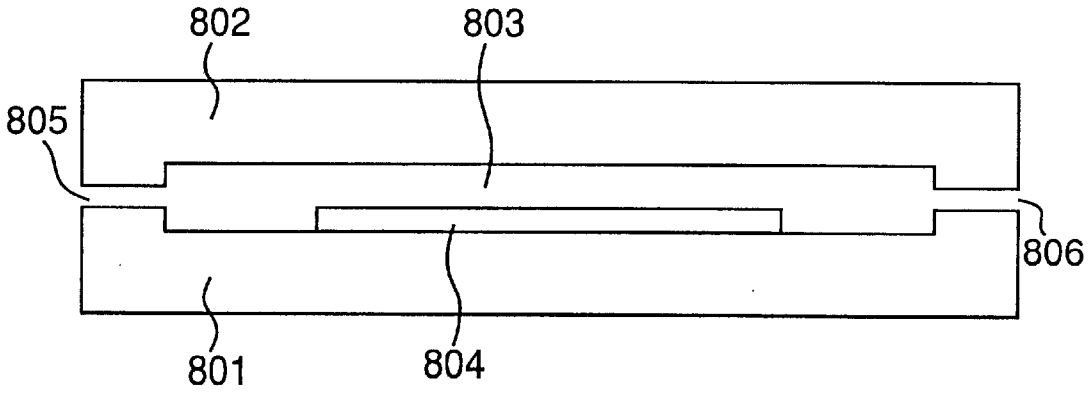
Fig.22 PRIOR ART
FIG. 22 is a diagram of a prior art liquid jetting apparatus.
Figure 23:
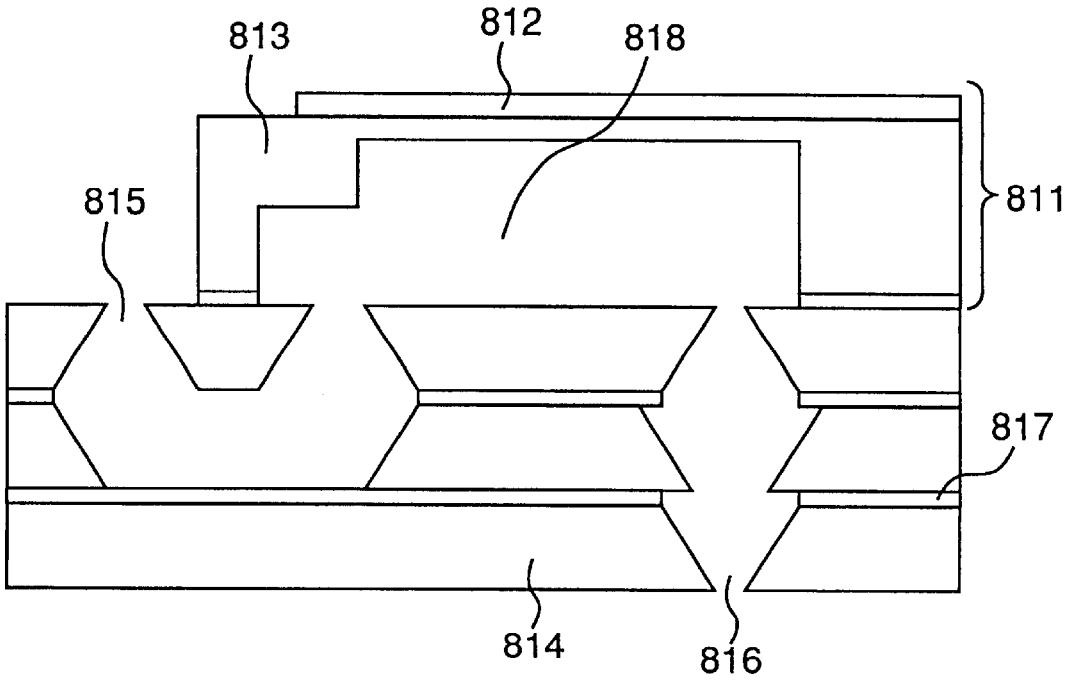
Fig.23 PRIOR ART
FIG. 23 is a diagram of a prior art liquid jetting apparatus.

(Step 3) The monocrystalline lithium niobate plates 101 and 102 are directly bonded together. The process of direct bonding is described below. The monocrystalline lithium niobate plates 101 and 102 are subjected to mirror-finish polishing to a specified thickness of, for example, 300$\mu$. Then the two plates 101 and 102 are subjected to a treatment to make them hydrophilic (FIG. 21(*a*)). This hydrophilic treatment is performed by washing with an alkaline cleaning solution and then thoroughly rinsing with pure water. Next, the two plates are stacked together (FIG. 21(*b*)). By this time some considerable adhesive effective is being realized, so the direct bonding may be terminated here. When greater bonding strength is needed, however, the material is subjected to heat treatment at 500° for 2 hours (FIG. 21(C)). This heat treatment may be performed anywhere within a temperature range of 100° C. to 1000° C., but the preferable temperature range is 200° C.–600° C. By this process, the two monocrystalline lithium niobate plates 101 and 102 are directly bonded. In addition, the directly bonded plates are subjected to mirror-finish polishing until each of the two monocrystalline lithium niobate plates 101 and 102 has a thickness of 20$\mu$.

Direct bonding will now be further described. Direct bonding may be implemented by the following process, for example.

(Step a) Mirror-finish the surfaces of the plates that will be placed together.

(Step b) Wash the plates and treat their surfaces to make them hydrophilic. When this is done, hydroxyl groups attach to the plate surfaces (FIG. 21(*a*)).

(Step c) Stack the plates together. When this is done, the hydroxyl groups on one surface form hydrogen bonds with the hydroxyl groups on the other surface (FIG. 21(*b*)).

(Step d) Perform heat treatment. When this is done, water molecules are evacuated, and an interatomic bond is attained (FIG. 21(*c*)).

By this process, the plates are directly bonded. In general, three types of bonding morphology exist in direct bonding, as noted below.

(A) Adhesion State Based on Hydrogen Bonds

This is an adhesive bonding state resulting from hydrogen bonding between hydroxyl groups deliberately attached to the plate surfaces in a pre-bonding process, or between trace amounts of residual water molecules.

(B) Adhesion State Based on Interatomic Bonds

Adhesion produced by interatomic bonding is a state in which the atoms that constitute the surface of the plates are directly bonded, without any intervening adhesive layer made up of atoms other than those constituting the plate surfaces. An example of such interatomic bonds is seen in the siloxane bond (Si—O—Si) that occurs when silicon plates are bonded together. Covalent bonds and ionic bonds are also interatomic bonds.

(C) Adhesion State Based on Coexistent Hydrogen and Interatomic Bonds

The above bonding states are altered primarily by the temperature of the heat treatment. By performing heat treatment at high temperatures, the bonding state will change in the order (A), (C), (B), with bonding strength also increasing in that order.

Because adhesion is affected at the atomic level with such direct bonding, stable bonding is realized, with almost no degradation over time. As will be described in detail for Embodiment 1, for example, when you have two piezoelectric bodies held together by direct bonding, there is almost no elastic energy loss at the bonding interface even when piezoelectric vibrations are created across that interface.

(Step 4) Electrodes 103 made of titanium and/or gold are formed by vacuum vapor deposition on the monocrystalline lithium niolbate plates 101 and 102 that are directly bonded. These processes yield a bimorph element 108. Next, a photosensitive film resist is applied to those portions that will adhere to the silicon plate 104, by photolithography. This photoresist is used in Step 5.

(Step 5) The bimorph element forming plate 108 is stacked together with the silicon plate 104, and the film resists 109*a* and 109*b* formed in Step 2 and Step 4 are brought into contact, placed under pressure, and bonded together. It is permissible to have the photoresist only on one side, however. Then cutting is performed, by dicing, to the shape depicted in FIG. 1.

What is characteristic of the fabrication method for the liquid jetting apparatus of this embodiment is the fabrication of the bimorph element forming plate 108 using direct bonding.

The fabrication method set forth above provides the following benefits.

By using direct bonding, the piezoelectric monocrystal can be easily rendered into a thin sheet, yielding a piezoelectric drive element having good characteristics, and making it possible to easily fabricate liquid jetting apparatuses with good productivity.

Second Embodiment

Figure 9A:
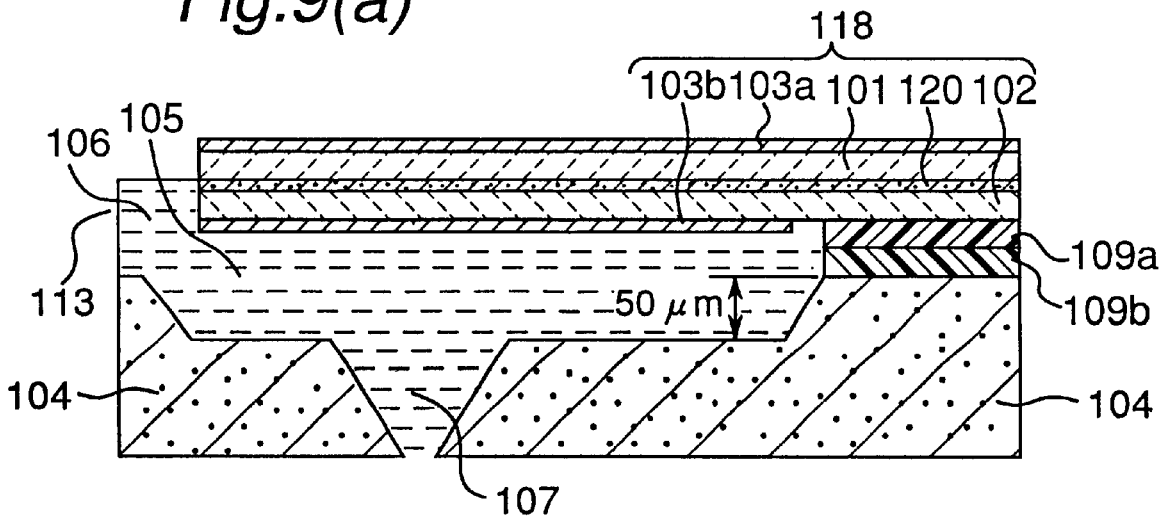
FIG. 9(*a*) is a cross-sectional view of a liquid jetting apparatus of a second embodiment, FIGS. 9(*b*) and 9(*c*) are cross-sectional views showing the polarization directions.
Figure 9B:
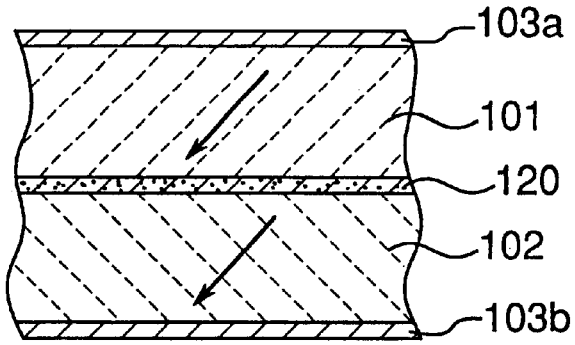
Figure 9C:
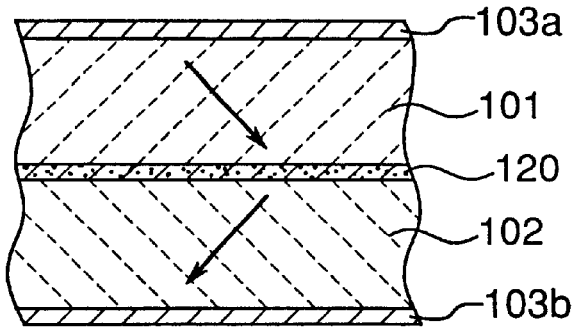

A second embodiment of the liquid jetting apparatus of the present invention is now described, making reference to FIG. 9. FIG. 9(*a*) is a cross-sectional view of one element that corresponds to FIG. 2(*b*) described in connection with the first embodiment.

In FIG. 9(*a*), item 120 is a low-resistance silicon layer that has been doped with phosphorus. The points of difference in this embodiment from the first embodiment are that the monocrystalline lithium niobate plates 101 and 102 are formed so that their polarization directions are the same, as diagrammed in FIGS. 9(*b*) and 9(*c*), and that a low-resistance silicon layer 120 is provided between the monocrystalline lithium niobate plates 101 and 102. This low-resistance silicon layer 120 is directly bonded to the monocrystalline lithium niobate plates 101 and 102 to configure the bimorph element 118. The bimorph element 118 is driven by applying a pulsing voltage between the low-resistance silicon layer 120 and the upper and lower electrodes 103*a* and 103*b* that are common with the low-resistance silicon layer 120.

Using the structure described in the foregoing, a piezoelectric drive element (bimorph element 118) can be realized which, in addition to providing the benefits noted in connection with the first embodiment, such as long life, little degradation over time, high dot size controllability, high dot reproducibility, and high-speed printing capability, also provides the benefit of permitting low-voltage drive by applying voltages separately to the monocrystalline lithium niobate plates 101 and 102.

Now will be described the process (Step 3) that is particularly different in the fabrication method of the liquid jetting apparatus of this embodiment from the first embodiment. A (100) plane silicon plate is doped with phosphorus by diffusion to form a low-resistance n+layer (low-resistance silicon layer 120). Then the surfaces of the monocrystalline lithium niobate plate 101 and the low-resistance silicon layer 120 on the silicon plate are directly bonded. The direct bonding process is described below. The monocrystalline lithium niobate plate 101 is mirror-finish polished to the prescribed thickness, say 300$\mu$, for example. Then the silicon plate is washed in a hydrofluoric acid based washing solution. The monocrystalline lithium niobate plate 101 and the silicon plate are subjected to a hydrophilic treatment by washing them with an alkali washing solution and rinsing them thoroughly in pure water. The previously mirror-finished surface of the low-resistance silicon layer 120 on the silicon plate is then stacked together with the monocrystalline lithium niobate plate 101, and this is heat-treated at 400° C. for 2 hours. This heat treatment can be done within a temperature range of 100° C. to 1000° C., but it is best to conduct it in the temperature range of 200–500° C. By the process described above, the silicon plate and the monocrystalline lithium niobate plate 101 are directly bonded. The bonded plates are then subjected to anisotropic etching using hydrazine. The etching is stopped by the low-resistance silicon layer 120, resulting in a plate made up of the monocrystalline lithium niobate plate 101 and the low-resistance silicon layer 120. Then the low-resistance silicon layer 120 is mirror-finish polished and directly bonded to the monocrystalline lithium niobate plate 102 by the same process. Thereafter, the process is generally the same as in the first embodiment.

The fabrication method just described provides the same benefits as the first embodiment.

As described in connection with a first embodiment, it is also permissible to use an adhesive in forming the piezoelectric drive element.

Third Embodiment

Figure 10:
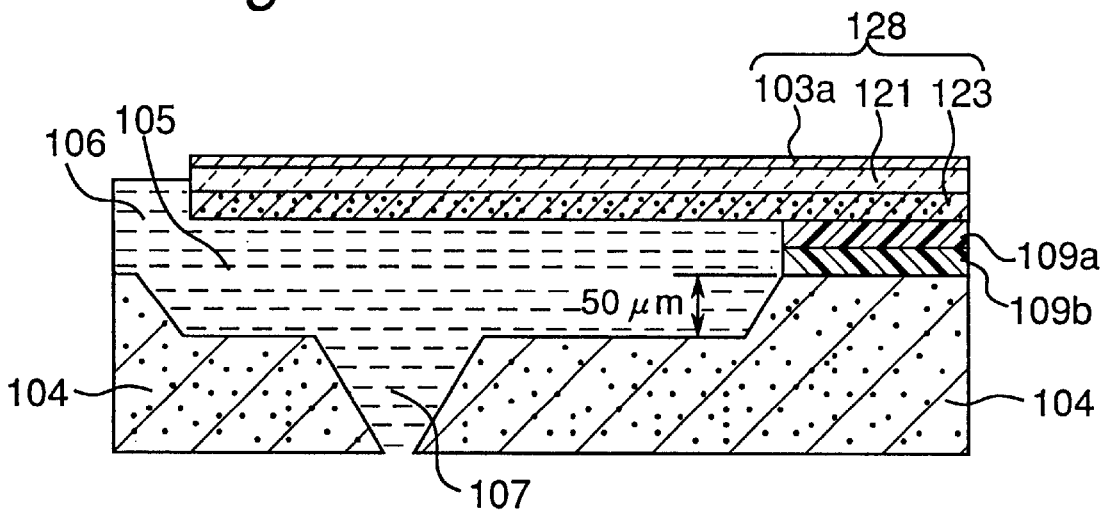
FIG. 10 is a cross-sectional view of a liquid jetting apparatus of a third embodiment.

A third embodiment of the liquid jetting apparatus of the present invention is now described, making reference to FIG. 10. FIG. 10 is a cross-sectional view of one element that corresponds to FIG. 2(*b*) discussed in conjunction with the first embodiment.

In FIG. 10, item 121 is a monocrystalline lithium niobate plate having a thickness of 20$\mu$. Item 123 is a silicon plate of 20$\mu$ thickness, on the side of which that faces the monocrystalline lithium niobate plate 121 is formed a low-resistance silicon layer by phosphorus doping, which is used as an electrode. Item 128 is a monomorph element. Except for the thicknesses noted, the sizes of these plates are generally the same as in the first embodiment.

What is different in this embodiment from the first and second embodiments is the fact that the piezoelectric drive element is a monomorph element.

The structure of the liquid jetting apparatus of this embodiment is now described. When a pulsing voltage is applied to the monocrystalline lithium niobate plate 121 in the thickness direction, the plate 121 elongates and contracts in the longitudinal dimension. The silicon plate 123 is joined to the monocrystalline lithium niobate plate 121 by direct bonding. Here, the silicon plate 123 functions as an electrode for applying voltage to the monocrystalline lithium niobate plate 121, and it also functions as a substrate for obtaining a flexure displacement from the piezoelectric vibrations of the monocrystalline lithium niobate plate 121. An electrode 103*a* is provided in opposition to the silicon plate 123 to function as an electrode for applying pulsing voltage to the monocrystalline lithium niobate plate 121. Thus is configured a monomorph element 128 having the structure just described. The monomorph element 128 is held secured to the silicon plate 104 through a film resist. The operating principle of the liquid jetting apparatus of this embodiment in general is the same as that of the first embodiment, except insofar as the silicon plate 123, which is a substrate, does not exhibit spontaneous displacement, but rather is a plate for making the elongation/contraction displacements of the monocrystalline lithium niobate plate 121 appear as flexure displacements in the monomorph element 128.

The characteristic points of the liquid jetting apparatus of this embodiment are that, in configuring the monomorph element 128, monocrystalline lithium niobate, which is a piezoelectric monocrystalline substance, is used as the piezoelectric member forming the monomorph element 128. Silicon, which exhibits small elastic energy loss, is used as the substrate. The substrate silicon also functions as an electrode for applying pulsing voltage to the monocrystalline lithium niobate plate 121; and the monocrystalline lithium niobate plate 121 and silicon plate 123 are joined by direct bonding.

By means of the structure just described, the same benefits can be obtained as in the first embodiment, even when the piezoelectric drive element is made a monomorph element. In addition, the structure can be simplified by having the silicon plate 123 double as both an electrode and a substrate. By making silicon the substrate, moreover, a monomorph element can be configured which is driven with low voltage and exhibits little energy loss. And, as an electrode that is immersed in liquid, this electrode exhibits almost no corrosion because it is a silicon plate.

It is possible to fabricate the liquid jetting apparatus of this embodiment using the fabrication method described in connection with the second embodiment. However, mechanical polishing is employed in this embodiment in making the silicon plate 123 into a thin sheet. By means of this fabrication method, the same benefits are realized as in the first embodiment.

Fourth Embodiment

Figure 11:
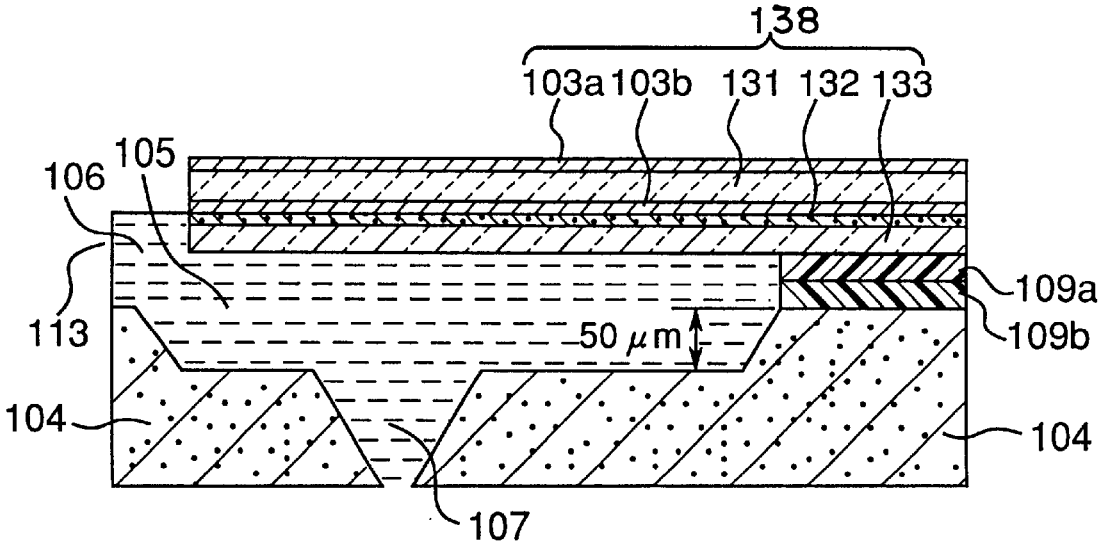
FIG. 11 is a cross-sectional view of a liquid jetting apparatus of a fourth embodiment.

A fourth embodiment of the liquid jetting apparatus of the present invention is now described, making reference to FIG. 11. FIG. 11 is a cross-sectional view of one element that corresponds to FIG. 2(*b*) discussed in conjunction with the first embodiment.

In FIG. 11, item 131 is a monocrystalline lithium niobate plate having a thickness of 20$\mu$. Item 132 is an inorganic thin-film layer such, for example, as a thin film of silicon oxide, of a thickness of 0.5$\mu$. Item 133 is a substrate such, for example, as a glass plate of thickness 20$\mu$ having a coefficient of thermal expansion of $8\times10^{-6}$/° C. Item 138 is a monomorph element. Except for the thicknesses noted, the sizes of these plates are in general the same as in the first embodiment.

In this embodiment, as in the third embodiment, the piezoelectric drive element is a monomorph element. What is different is the fact that, here, the monocrystalline lithium niobate plate 131 is directly bonded on its back surface to the substrate (i.e., to the glass plate 133) through the electrode 103*b* and the silicon oxide thin film 132. The actual direct bond, however, is formed between the glass plate 133 and the silicon oxide thin film 132.

By means of the structure just described, the effectiveness realized is generally the same as with the third embodiment, except insofar as it is inferior in terms of reducing energy loss. Nevertheless, unlike the third embodiment, metal electrodes 103*a*, 103*b* are used above and below the monocrystalline lithium niobate plate 131, wherefore electrode resistivity is lower than in the third embodiment, which is advantageous when using the piezoelectric drive element in a low-impedance region (near resonance). Furthermore, in the direct bond, since the glass plate 133 has a coefficient of thermal expansion near that of the monocrystalline lithium niobate plate, residual stress and the thermal stress added by ambient temperature changes can be reduced, and malfunctions caused by temperature changes can be lessened.

The fabrication method for the liquid jetting apparatus of this embodiment is, except for the processes in (Step 3), generally the same. The (Step 3) processes are now described. Electrodes 103 laminated of titanium and/or gold are fabricated by vacuum vapor deposition on the monocrystalline lithium niobate plate 131. Also, a thin film 132 of silicon oxide is fabricated on the electrode 103 by sputtering. The surface of the silicon oxide thin film 132 formed in this manner onto the plate is then directly bonded to the glass plate 133. The process for doing this is now described. The two plates are subjected to a hydrophilic treatment by washing them in an alkaline wash solution and then thoroughly rinsing them in pure water. The surfaces of the glass plate 133 and the silicon oxide thin film 132 are then stacked together and subjected to heat treatment at 300° for 2 hours. This heat treatment can be done in a temperature range of 100° C. to 600° C., but it is best done in the range of 100–400° C. By means of this process, the plates made up of the glass plate 133, monocrystalline lithium niobate plate 131, electrodes 103, and silicon oxide thin film 132 are directly bonded to each other. Next, the glass plate 133 of the bonded plates so fabricated is made into a thin sheet by polishing, and then mirror-finished by further polishing.

By means of this fabrication method, in addition to the benefits of the third embodiment, the following benefits are realized. In the direct bond between the glass and the monocrystalline material, strong bonding force can be secured at a lower heat-treating temperature than when two monocrystalline materials are directly bonded. As a result, the temperature during heat treatment can be lowered, thus relaxing the demand for high heat resistance in materials when fabricating the elements. Furthermore, glass is available in an abundance of types, having various coefficients of thermal expansion. Thus there is great freedom with regard to the coefficient of thermal expansion. That being so, the coefficient of thermal expansion can be selected by the materials bonded together. This permits post-fabrication residual stress and thermal stress imparted by ambient temperatures to be reduced, and makes it possible to fabricate long-lasting elements exhibiting little characteristic degradation.

Fifth Embodiment

Figure 12A:
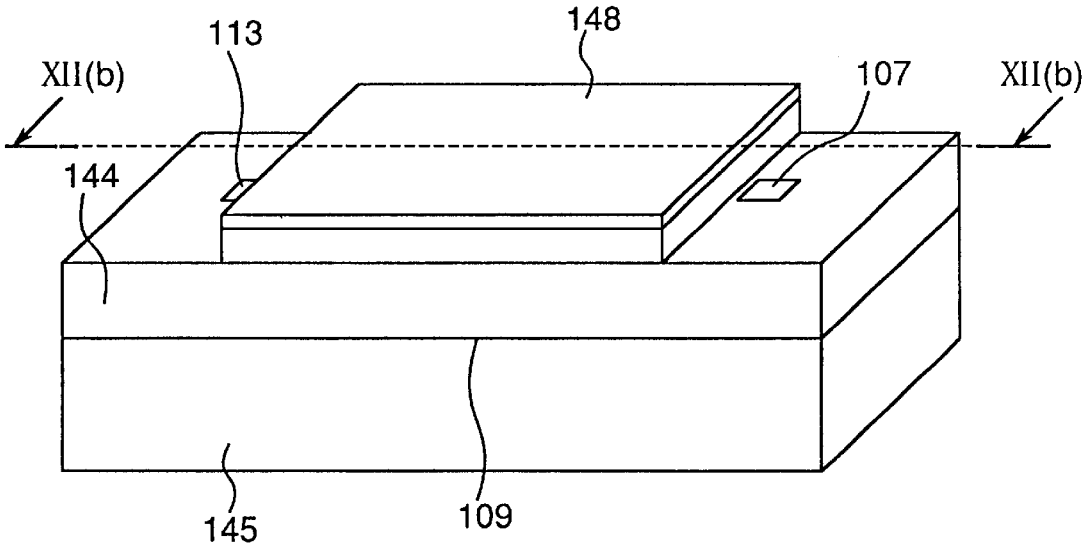
FIGS. 12(*a*) and 12(*b*) are a perspective view and a cross-sectional view, respectively, of a liquid jetting apparatus of a fifth embodiment.
Figure 12B:
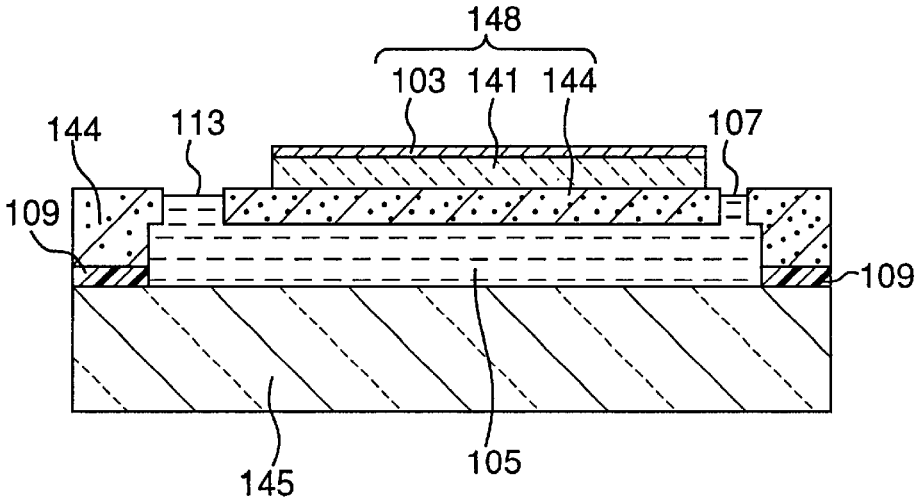

A fifth embodiment of the liquid jetting apparatus of the present invention will now be described, making reference to FIG. 12. FIG. 12(*a*) is a diagonal view of a single element in FIG. 1 discussed in connection with the first embodiment. FIG. 12(*b*) is a cross-sectional view taken along a line XII(b)—XII(b) shown in FIG. 12(*a*).

In FIG. 12, item 141 is a monocrystalline lithium niobate plate having a thickness of 20$\mu$. Item 144 is a silicon plate with a (110) plane at its surface. Silicon plate 144 has a concave formation at its bottom surface, and the bottom thickness is 20$\mu$. The bottom surface of the silicon plate 144 is directly bonded with the monocrystalline lithium niobate plate 141. The direct bonding surface is formed with a low-resistance silicon layer doped with phosphorus. Item 145 is a glass plate (i.e. support plate) having a coefficient of thermal expansion of $3.4\times10^{-6}$. Glass plate 145 is bonded through the film resist 109 to the open flat face of the silicon plate 144 to close the concave formation, thus defining a liquid reservoir 105 to store a liquid. Item 148 is a monomorph element comprising the monocrystalline lithium niobate plate 141, silicon plate 144, and electrode 103. Item 113 is an ink injection port and item 107 is an ink jet port, both of which are provided in the surface of each element (on the monomorph element side). Except for the stated thickness and the fact that the dimension of the monomorph element is 4.5 mm in the lateral direction (longitudinal direction), the sizes of the plates are in general the same as in the first embodiment.

What is characteristic in the liquid jetting apparatus in this embodiment is the fact that the liquid reservoir, liquid jet port, and liquid injection port are all integrated on the plate that forms the substrate in the piezoelectric drive element (monomorph element). Thus, to the benefits provided by the third embodiment, this embodiment adds the benefit of being an apparatus that can be formed in a simple structure.

It is possible to fabricate the liquid jetting apparatus of this embodiment by applying the fabrication method described for the third embodiment. Here, however, after directly bonding the monocrystalline lithium niobate plate 141 and the silicon plate 144, the monocrystalline lithium niobate plate 141 and the silicon plate 144 are made into thin sheets and subjected to etching, wherefore the process is further simplified, and manufacturing costs are further reduced. The benefits mentioned in connection with the fabrication method of the third embodiment are also realized.

Sixth Embodiment

Figure 13A:
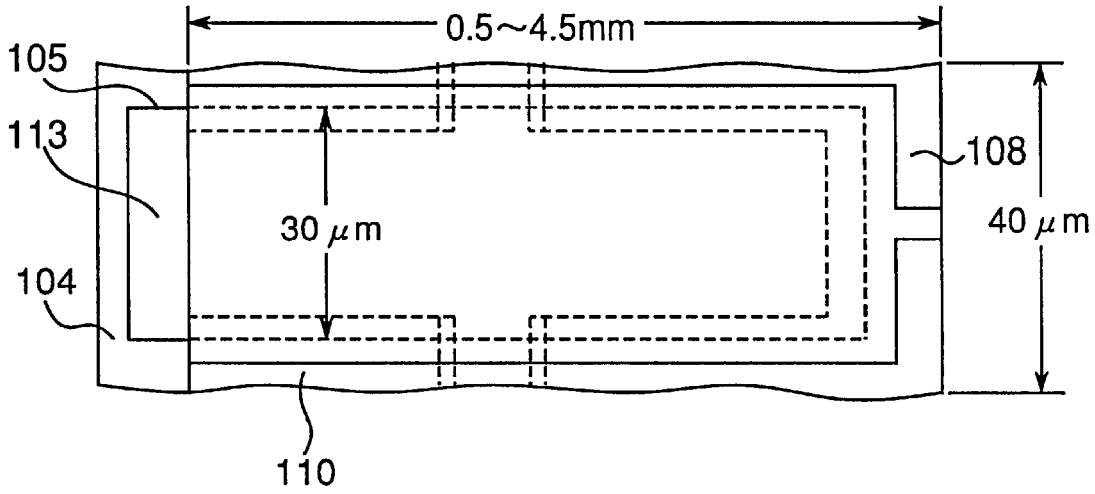
FIGS. 13(*a*), 13(*b*) and 13(*c*) are a plan view, a cross-sectional view, and a bottom view, respectively, of a liquid jetting apparatus of a sixth embodiment.
Figure 13B:
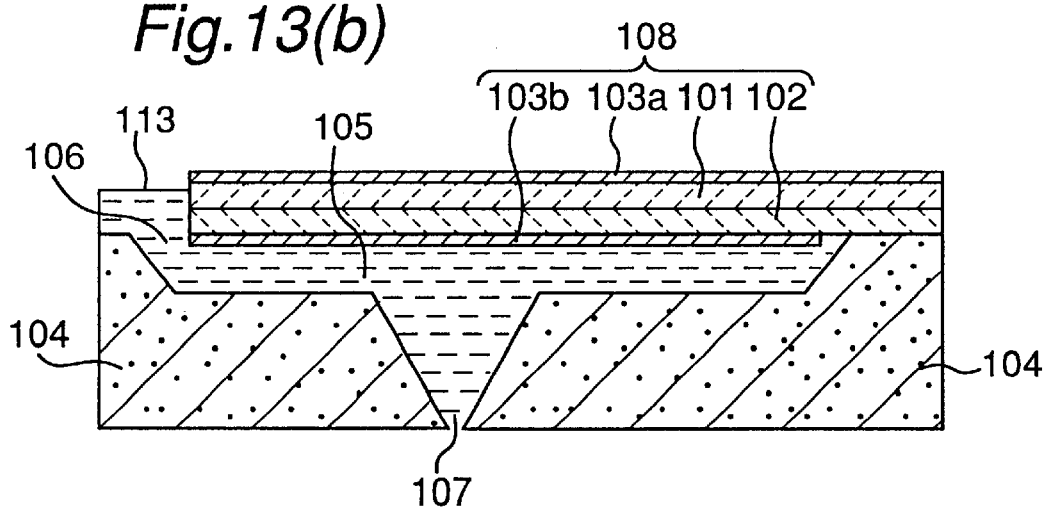
Figure 13C:
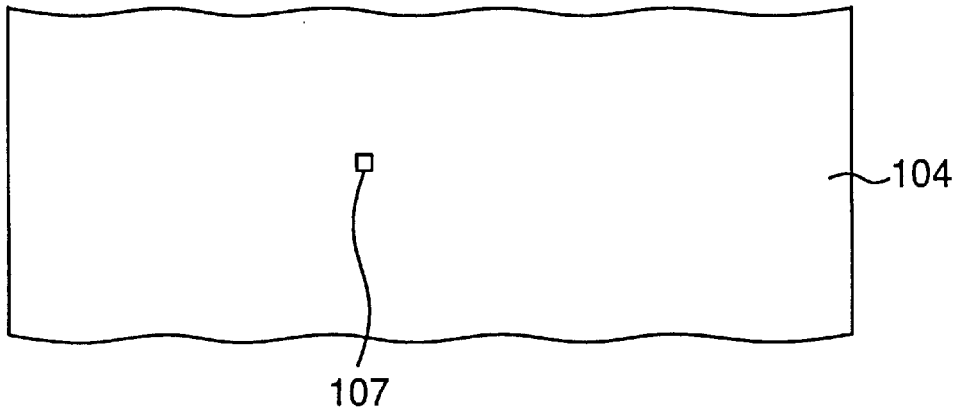

A sixth embodiment of the liquid jetting apparatus of the present invention will now be described, making reference to FIG. 1 and FIG. 13. Some of the dimensions cited in conjunction with the first embodiment in FIG. 1 will be different, however. The same reference characters are used as for the first embodiment. FIG. 13 is a diagram of one element in a liquid jetting apparatus. FIG. 13(*a*) is a plan view thereof, FIG. 13(*b*) a lateral cross-sectional view of FIG. 13(*a*), and FIG. 13(*c*) a bottom view.

What is different in the liquid jetting apparatus of this embodiment from the first embodiment is the fact that the bimorph element 108 is secured to the holding plate 104 by direct bonding. When this is done, moreover, the dimensions of the apparatus are altered, so those dimensions are now stated. The dimensions of the overall liquid jetting apparatus in FIG. 13 are 24 mm along the long side and 6.5 mm along the short side (longitudinal dimension of the piezoelectric element). In FIG. 13, moreover, the dimensions of each of the monocrystalline lithium niobate plates 101 and 102 per element are 40$\mu$ in the vertical (width direction), 4.5 mm in the horizontal (longitudinal direction), and 20$\mu$ in thickness. The aperture of the void 105 in the silicon plate 104, viewed from above, is 30$\mu$ in the vertical direction and 4.2 mm in the horizontal direction (cf. FIG. 13(*a*)). The aperture of the jet port 107, viewed from below, is 10$\mu$ in the vertical direction and 10$\mu$ in the horizontal direction (cf. FIG. 13(*c*)). As described above, then, the shapes are finer than in the first embodiment.

What is characteristic in the liquid jetting apparatus of this embodiment is the fact that the piezoelectric drive element (bimorph element) and the holding plate (silicon plate 104) are secured together by direct bonding.

The following benefits are afforded by the structure described in the foregoing.

A first benefit arises from the fact that direct bonding is strong bonding at the atomic level. Direct bonds provide adequate bonding force even when the holding area is small, making it possible to narrow the element placement interval to 40$\mu$, as in this embodiment. When elements of minute area are integrated by securing them through an adhesive layer, adequate bonding force is not realized. Because the holding force is weak, piezoelectric drive element displacements are transmitted to adjacent elements, which is a problem.

A second benefit arises from the fact that the piezoelectric drive element is not separately bonded to another plate through material of low rigidity (i.e. an adhesive). When holding is done using a material having low rigidity, such as an adhesive, it is difficult for the pressures applied to the piezoelectric drive element to be transmitted efficiently. This means that a displacement in the piezoelectric drive element becomes necessary which is greater than should be necessary, which necessitates high drive voltage. This phenomenon is interrelated with the rigidity of the adhesive layer: the greater the thickness of the adhesive layer (i.e. the smaller the rigidity), the more conspicuously the phenomenon appears. This being so, irregularities in adhesive layer thickness directly affect the characteristics of the individual piezoelectric drive elements, and jetting characteristics can even vary in the same piezoelectric drive element. In other words, the liquid jetting reproducibility is impaired. When direct bonding is employed, there is direct adhesion between the atoms or the functional groups that constitute the surfaces of the plates (i.e. interatomic bonding), and there is no adhesive layer involved, so pressures applied to the piezoelectric drive element can be transmitted to the liquid efficiently. Also, there is virtually no variation in jetting characteristics due to irregularities in adhesive layer thickness. As a result of these advantages, low-voltage drive becomes possible, and good liquid jetting reproducibility can be realized.

A third benefit arises because the piezoelectric drive element does not have a thick intervening adhesive layer in it. When a liquid adhesive or a solid adhesive sheet is used in bonding together a piezoelectric drive element with a plate that configures a liquid reservoir, the adhesive layer oozes into the liquid reservoir. This alters the capacity of the liquid reservoir, changes the jetting characteristics, and impairs jetting reproducibility, etc. Furthermore, the liquid reservoir is at the same time also the flow path through which the liquid flows, and it is necessary that the partitions that form the reservoir exhibit the same wettability (i.e. the same surface energy) relative to the liquid. When a region develops where the adhesive layer has oozed into the reservoir, that region will not have the same wettability relative to the liquid, and this is which makes it easy for air bubbles to get inside the liquid, a development that creates problems. Once air bubbles get into the liquid reservoir, the liquid will not be jetted unless the liquid is put under a greater than necessary pressure. By employing direct bonding, there can be no adhesive layer oozing, and the problems noted above are resolved.

A fourth benefit arises from the fact that with direct bonding, there is virtually no strength deterioration or change over time due to mechanical fatigue at the site of joining. This contributes to greater jetting characteristic reproducibility, and means that there will be practically no deterioration or change over time at the holding site even when the piezoelectric drive element is driven at high frequency, thus facilitating high-speed printing.

A fifth benefit arises from the fact that the direct bond is a mechanically stable bond. Hysteresis induced by an adhesive, as discussed in connection with the first embodiment, will occur when an adhesive is used at the holding site, but, as in the first embodiment, those problems are herewith resolved.

Furthermore, in the liquid jetting apparatus of this embodiment, by employing a piezoelectric monocrystal as the piezoelectric body for configuring the piezoelectric drive elements, and by forming the piezoelectric drive elements by direct bonding, the benefits discussed in connection with the first embodiment are of course realized. Nevertheless, the peculiar benefits of this embodiment, noted above, are effective by themselves, and are not limited to these structures.

The fabrication method for the liquid jetting apparatus of this embodiment differs from the fabrication method for the first embodiment in the following particulars. In the first embodiment, film resist (resin sheet) patterns were formed on plates, and pressure bonding was effected in the (Step 5) process. In this embodiment, however, a process is adopted whereby the holding plate 104 and the piezoelectric drive element 108 are directly bonded. In the direct bonding process, except insofar as heat treating is conducted at 350° C. for 2 hours, the process is generally the same as that for directly bonding the silicon and the monocrystalline lithium niobate plates in the second embodiment.

The fabrication method just described affords the following benefits. In the first embodiment, it was necessary to position the film resist pattern with great precision, which places restrictions on element shape miniaturization. By using direct bonding, however, the demand for positioning precision is lessened. Thus apparatuses in which miniature elements are aligned can be easily fabricated at high precision, so that nozzles can be arrayed with narrower pitch, and both small dot diameters and multiple-nozzle implementation can be realized simultaneously. In this embodiment, moreover, a direct bonding process is employed in fabricating the piezoelectric drive elements, so manufacturing costs are reduced.

Seventh Embodiment

Figure 14:
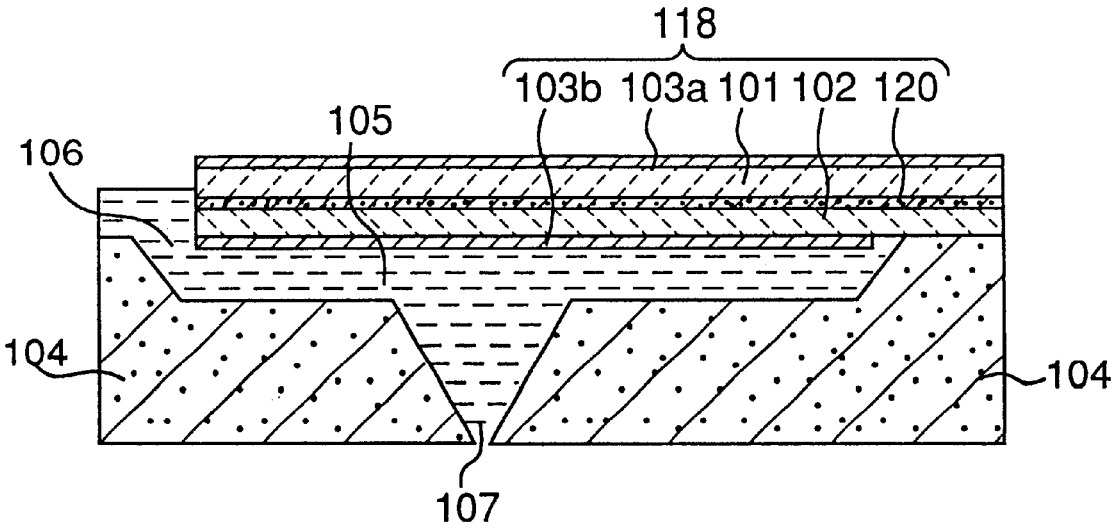
FIG. 14 is a cross-sectional view of a liquid jetting apparatus in a seventh embodiment.

A seventh embodiment of the liquid jetting apparatus of the present invention will now be described, making reference to FIG. 14. FIG. 14 is a cross-sectional view of one element corresponding to FIG. 2(*b*) discussed in connection with the first embodiment.

What is different in this embodiment from the second embodiment is the fact that the bimorph element 118 is secured to the holding plate 104 by means of direct bonding. The dimensions of the apparatus are generally the same as in the sixth embodiment.

The characteristic point in the liquid jetting apparatus of this embodiment is the same as in the sixth embodiment, namely that the piezoelectric drive element (bimorph element) and the holding plate (silicon plate 104) are joined by direct bonding. This structure affords the same benefits as does the sixth embodiment.

The liquid jetting apparatus of this embodiment can be implemented by combining the fabrication methods of the second and the sixth embodiments.

Eighth Embodiment

Figure 15:
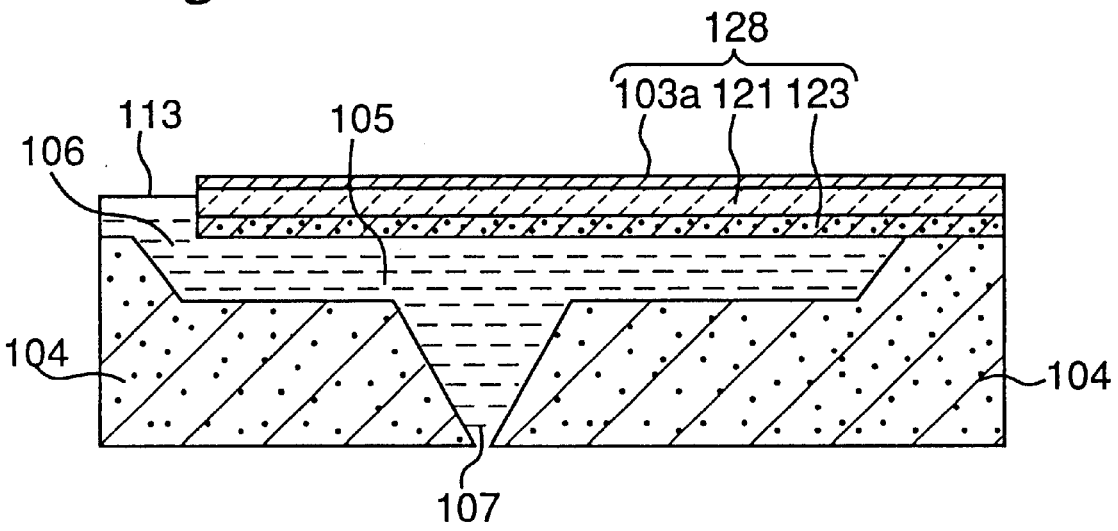
FIG. 15 is a cross-sectional view of a liquid jetting apparatus in an eighth embodiment.

An eighth embodiment of the liquid jetting apparatus of the present invention will now be described, making reference to FIG. 15. FIG. 15 is a cross-sectional view of one element corresponding to FIG. 2(*b*) discussed earlier in connection with the first embodiment.

What is different in the liquid jetting apparatus of this embodiment from the third embodiment is the fact that the monomorph element 128 is secured to the holding plate 104 (i.e., concave casing) by direct bonding. The dimensions of the apparatus are generally the same as in the sixth embodiment.

What is characteristic in the liquid jetting apparatus of this embodiment is the same as in the sixth embodiment, namely that the piezoelectric drive element (monomorph element) and the holding plate (silicon plate 104) are joined by direct bonding. This structure affords the same benefits as does the sixth embodiment.

The liquid jetting apparatus of this embodiment can be implemented by combining the fabrication methods of the third and the sixth embodiments.

Ninth Embodiment

Figure 16:
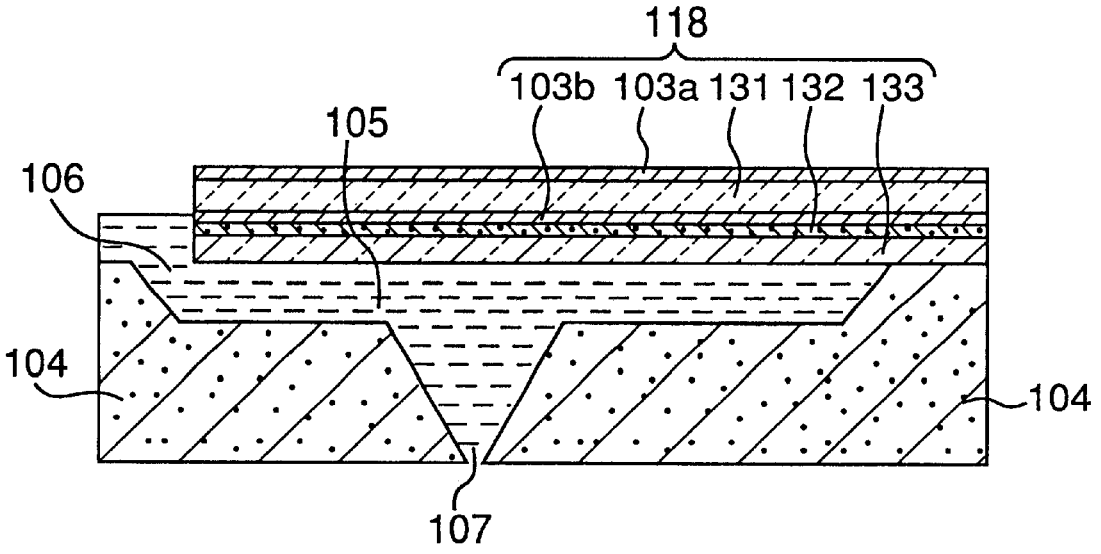
FIG. 16 is a cross-sectional view of a liquid jetting apparatus in a ninth embodiment.

A ninth embodiment of the liquid jetting apparatus of the present invention will now be described, making reference to FIG. 16. FIG. 16 is a cross-sectional view of one element corresponding to FIG. 2(*b*) discussed earlier in connection with the first embodiment.

What is different in the liquid jetting apparatus of this embodiment from the fourth embodiment is the fact that the monomorph element 138 is secured to the holding plate 104 by direct bonding, which, in this case, is direct bonding between glass and silicon. The dimensions of the apparatus are generally the same as in the sixth embodiment.

The structure described above provides the following benefits in addition to those described in connection with the sixth embodiment. Glass and silicon are used for the bonded materials, so, by appropriately selecting the coefficient of thermal expansion of the glass, residual stress and thermal stress caused by ambient temperature changes can be lessened, and element characteristic degradation can also be reduced. The useful life of the element is also lengthened. The glass coefficient of thermal expansion is now discussed in more detail. In this embodiment, a glass plate having a coefficient of thermal expansion of $8\times10^{-6}/°$ C. is employed, so the stress produced by the difference in coefficient of thermal expansion between the monocrystalline lithium niobate plate 131 and the silicon plate 104 is moderated. The glass coefficient of thermal expansion selected is usually a value intermediate between the maximum coefficient of thermal expansion of the piezoelectric body (lithium niobate in this embodiment) and the coefficient of thermal expansion of the holding plate (silicon in this embodiment). In the combination adopted in this embodiment, a glass having a coefficient of thermal expansion of from $15\times10^{-6}/°$ C. to $4\times10^{-6}/°$ C. can be used, but it is preferable that a glass having a coefficient of thermal expansion of between $11\times10^{-6}/°$ C. and $6\times10^{-6}/°$ C. be used.

The fabrication method for the liquid jetting apparatus of this embodiment differs from the fabrication method described for the fourth embodiment in that the process of joining the piezoelectric drive element and the holding plate is different. Here a process is adopted whereby the holding plate 104 and the piezoelectric drive element 138 are directly joined. This direct joining process is now described. The silicon plate 104 is washed with a hydrofluoric acid based wash solution. Then the silicon plate 104 and the monomorph element 138 are washed with an alkaline wash solution. The plate and element are then thoroughly rinsed in pure water. The process just described effects a hydrophilic treatment. Next, the two plates are stacked together in the prescribed position and heat-treated at 300° C. for 2 hours. This heat treatment can be performed in a temperature range of from 100° C. to 600° C., but it is best that it be performed in the temperature range of 100° C.–400° C. These heat-treatment temperatures are lower than those cited in connection with the sixth embodiment, but the same order of bonding force is obtained here because glass is used as one of the bonding materials. By means of the process described in the foregoing, the silicon plate 104 and the glass plate 133 constituting the configurational materials of the monomorph element 138 are directly bonded.

The fabrication method described above provides the following benefits. With direct bonding when one of the plates used is glass, strong bonding force is obtained at lower heat-treatment temperatures than with direct bonding of two monocrystalline materials. Therefore, the heat-treatment temperature during direct bonding can be lowered, thus lessening the demand for high-temperature heat resistance in materials when fabricating the elements. Also, glass is available in an abundance of types exhibiting various coefficients of thermal expansion, so there is great freedom with regard to the coefficient of thermal expansion. Accordingly, by selecting the coefficient of thermal expansion, post-fabrication residual stress and thermal stress imparted by ambient temperatures can be lessened, and longer-lasting elements can be manufactured.

Tenth Embodiment

Figure 17A:
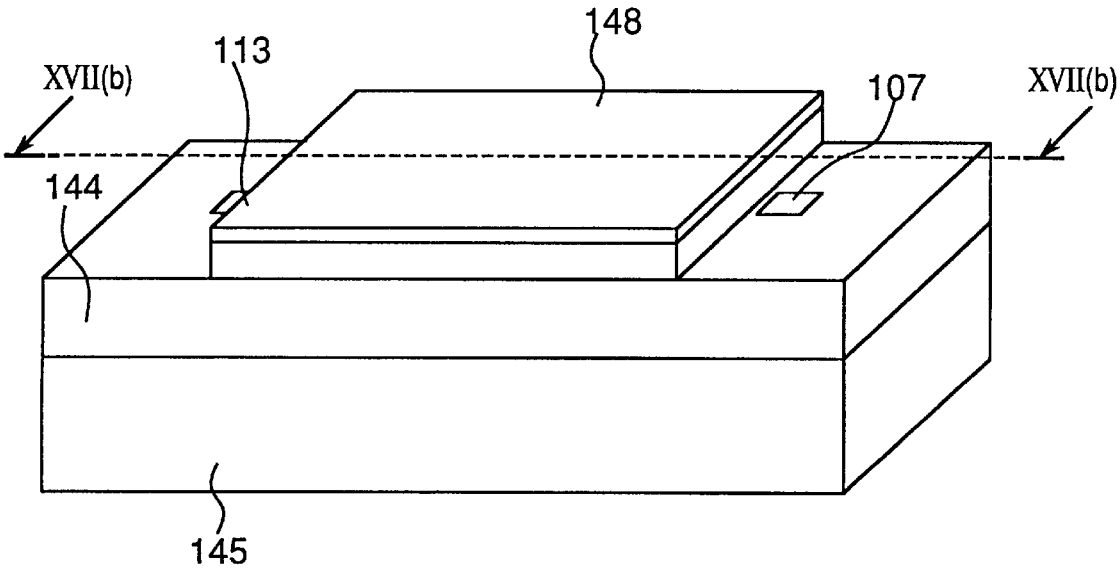
FIGS. 17(*a*) and 17(*b*) are a perspective view and a cross-sectional view, respectively, of a liquid jetting apparatus of a tenth embodiment.
Figure 17B:
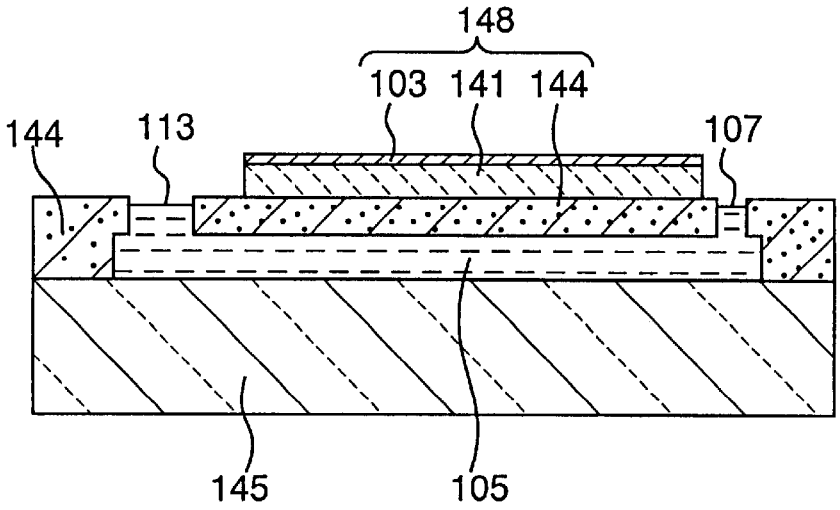

A tenth embodiment of the liquid jetting apparatus of the present invention is now described, making reference to FIG. 17. FIG. 17(*a*) is a diagonal view of only one element in FIG. 1 described in connection with the first embodiment. FIG. 17(*b*) is a cross-sectional view taken along line XVII (b)—XVII(b) shown in FIG. 17(*a*).

What is different in the liquid jetting apparatus of this embodiment from the fifth embodiment is the fact that the monomorph element 148 is secured to the holding plate 144 by direct bonding. The dimensions of the apparatus are generally the same as in the sixth embodiment.

The characteristic point of the liquid jetting apparatus of this embodiment is the same as in the sixth embodiment, namely that the piezoelectric drive element (monomorph element) and the holding plate (silicon plate 144) are bonded together by direct bonding. This structure provides the same benefits as does the sixth embodiment.

11th Embodiment

Figure 18:
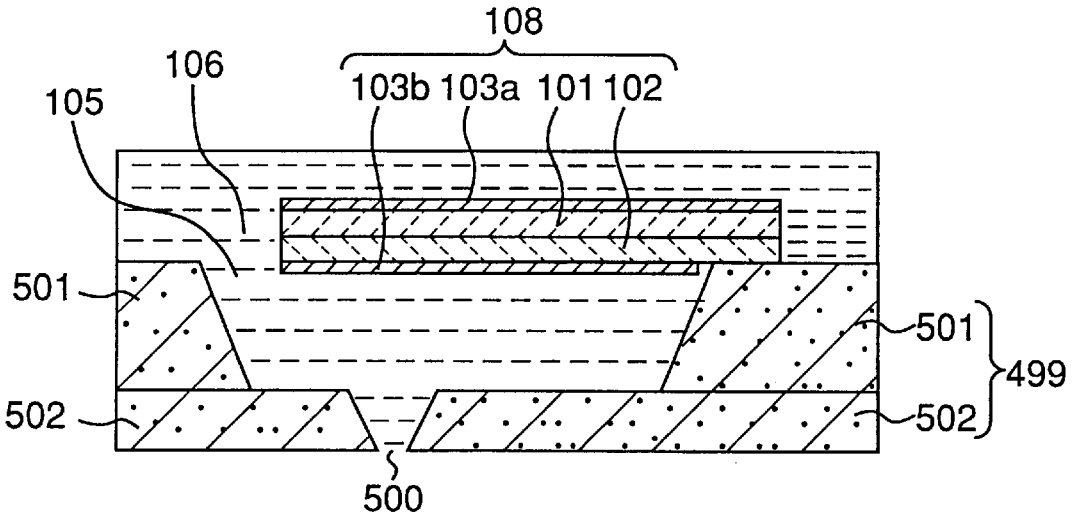
FIG. 18 is a diagonal view of a liquid jetting apparatus in an 11th embodiment.

An 11th embodiment of the liquid jetting apparatus of the present invention will now be described, making reference to FIG. 18. FIG. 18 is a cross-sectional view of one element corresponding to FIG. 2(*b*) discussed earlier in connection with the first embodiment.

The structure of the liquid jetting apparatus of this embodiment is now described and the reference characters are explained. In FIG. 18, items 501 and 502 are silicon plates with (100) planes at their surface, the vertical and horizontal dimensions of which are the same as in the sixth embodiment. Silicon plate 502 serves as a base plate and silicon plate 501 serves as a side frame plate, so that when the side frame plate 501 is directly bonded on the base plate 502, a concave casing is defined. The thickness of the silicon plate 501, however, is 50$\mu$ and that of the silicon plate 502 is 100$\mu$. Item 500 is a jet port provided in the silicon plate 501, the dimensions of the aperture of which, viewed from the lower surface of the silicon plate 502, are 10$\mu$ in both the vertical and horizontal. Item 499 is the plate that is formed by directly bonding together the silicon plates 501 and 502.

The fabrication method for the liquid jetting apparatus of this embodiment is next described. What is described is the process of directly bonding the silicon plates 501 and 502, which differs from the sixth embodiment. The silicon plates 501 and 502 are mirror-finish polished to the prescribed thicknesses, and then provided with the void 105 and jet port 500 at the prescribed locations by anisotropic etching. Next, the silicon plate 501 and the silicon plate 502 are directly bonded. The process for this direct bonding is now described. The two plates are washed in a hydrofluoric acid based wash solution, and then washed with an alkaline wash solution and thoroughly rinsed in pure water. By this process the plate surfaces are given a hydrophilic treatment. Then the two plates are stacked together in the prescribed position and heat-treated. This heat treatment can be done in a temperature range of from 100 to 1200° C., but it is preferable that it be done within a temperature range of 300° C.–1200° C. In this embodiment, heat treatment is performed at 1100° C. for 2 hours. Then the joined plate 499 is finished to the prescribed thickness, after which the bimorph element 108 and the silicon plate 499 are directly joined by the same process as given for the sixth embodiment.

Thus the silicon plate 501 that is the main plate for forming the ink reservoir void 105 and the silicon plate 502 that is the main plate for forming the jet port 500 are bonded together by direct bonding.

By means of the structure just described, because silicon is used for the materials, the liquid jet port and the liquid reservoir can be given fine, high-precision shapes, thus affording the benefit of being able to realize high dot reproducibility and to implement multiple nozzles. And by using a silicon plate with a (100) crystal plane at its surface as the main configurational plate for the liquid reservoir, the benefit of being able to realize further miniaturization in the apparatus by forming CMOS or other types of circuit elements is afforded.

Also, the fabrication method described above provides the following benefits. Because the liquid reservoir and the liquid jet port are fabricated separately, using individual plates (silicon plates 501 and 502), the photolithography process for the plates and the anisotropic etching process can be simplified. Furthermore, compared to plates having other surface azimuths, the silicon plate with the (100) plane at the surface is an all-purpose plate that is available at low cost.

In this embodiment, the silicon plate 501 having the (100) plane surface is used as the main plate for forming the void 105, but further element miniaturization can be effected by using the (110) plane silicon plate 503 that is etched in the perpendicular direction, relative to the plate surface, by performing anisotropic etching.

12th Embodiment

Figure 19:
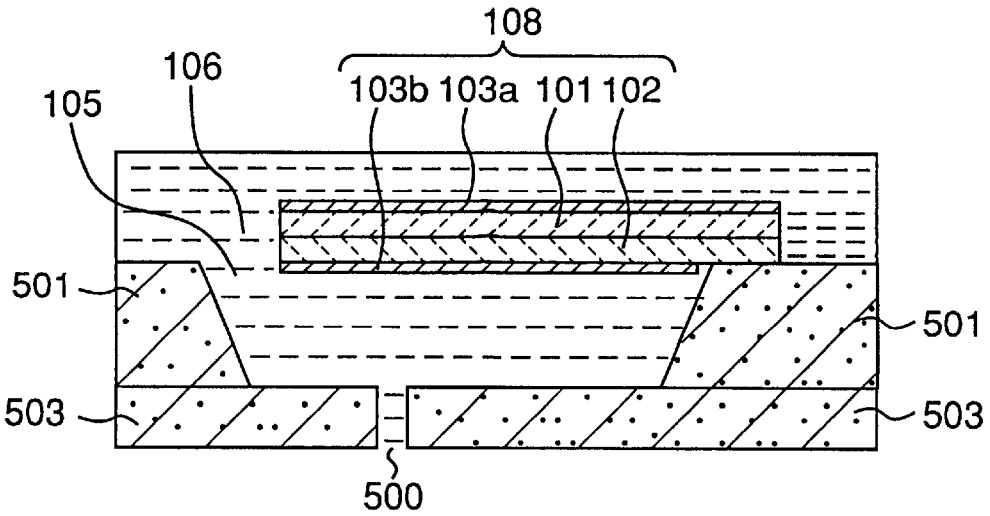
FIG. 19 is a diagonal view of a liquid jetting apparatus in a 12th embodiment.

A 12th embodiment of the liquid jetting apparatus of the present invention is now described, making reference to FIG. 19. FIG. 19 is a cross-sectional view of one element correspond to FIG. 2(*b*) described earlier in connection with the first embodiment.

The structure of and fabrication method for the liquid jetting apparatus of this embodiment are now described, focussing on points of difference with the 11th embodiment. In this embodiment, the liquid jet port 500 is formed using a silicon plate 503 with a (110) crystal plane at the plate surface. For the formation of the liquid jet port 500, anisotropic etching is used as in the 11th embodiment.

What is characteristic in the liquid jetting apparatus of this embodiment, in addition to what is characteristic in the 11th embodiment, is the use, for the main plate forming the liquid jet port 500, of the (110) plane silicon plate 503 that is etched in the perpendicular direction, relative to the plate surface, by performing anisotropic etching.

The structure and fabrication method described above provide, in addition to the benefits of the 11th embodiment, the following benefits. By forming the liquid jet port in the perpendicular direction relative to the surface of the plate, the liquid is propelled more directly, and dot reproducibility is further improved. Also, it becomes easier to precisely control the shape of the aperture of the liquid jet port, which can be controlled by performing micron-order ultra-fine machining, making it possible to realize high dot reproducibility, small dot sizes, and multiple nozzle implementation. And, since the silicon plate 501, which is the main configurational plate for the liquid reservoir, is a silicon plate with the (100) plane at its surface, further apparatus miniaturization can be realized by forming CMOS or other types of circuit elements.

13th Embodiment

Figure 20:
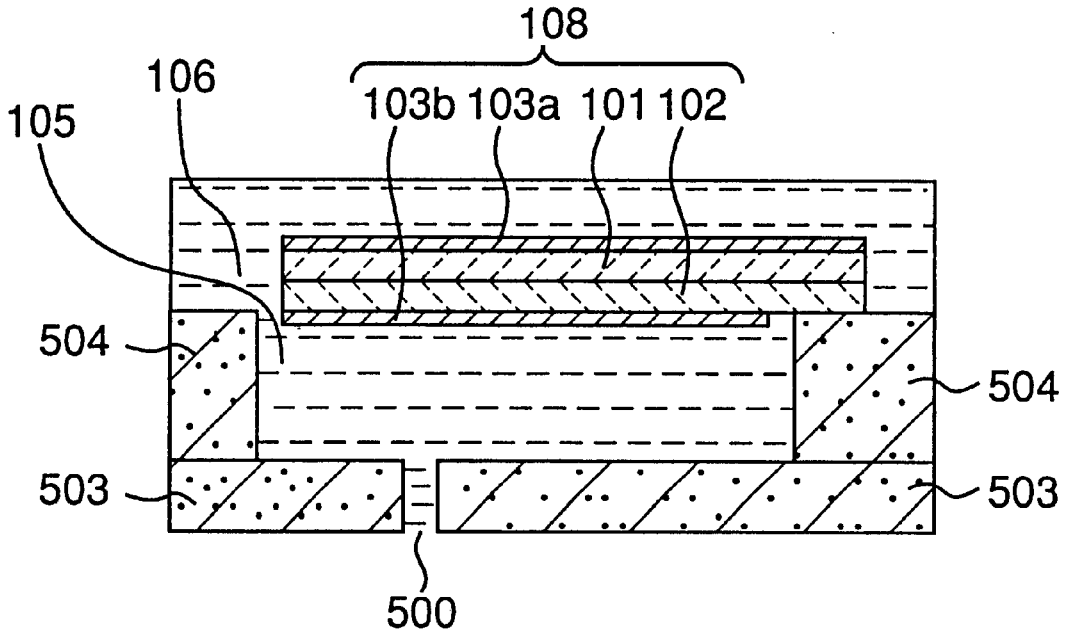
FIG. 20 is a diagonal view of a liquid jetting apparatus in a 13th embodiment.

A 13th embodiment of the liquid jetting apparatus of the present invention will now be described, making reference to FIG. 20. FIG. 20 is a cross-sectional view of one element corresponding to FIG. 2(*b*) discussed already in connection with the first embodiment.

The structure of, and the fabrication method for, the liquid jetting apparatus of this embodiment will now be described, focussing on the points of difference with the 12th embodiment. In the liquid jetting apparatus of this embodiment, the liquid reservoir 105 is formed using the silicon plate 504 having a (110) crystal plane at the plate surface. In forming the liquid jet port 500, anisotropic etching is employed as in the 12th embodiment.

What is characteristic in the liquid jetting apparatus of this embodiment, in addition to what is characteristic in the 12th embodiment, is the use, for the main plate forming the liquid reservoir 105, of the (110) plane silicon plate 504 that is etched in the perpendicular direction, relative to the plate surface, by performing anisotropic etching.

The structure and fabrication method described above provide, in addition to the benefits of the 11th embodiment, the ability to make the apparatus even smaller by using the silicon plate 504 with the (110) plane at its surface.

14th Embodiment

A 14th embodiment of the liquid jetting apparatus of the present invention will now be described, making reference to FIG. 19.

The structure of and fabrication method for the liquid jetting apparatus of this embodiment will now be described, focusing on the points of difference with the 12th embodiment. In the liquid jetting apparatus in this embodiment, the liquid reservoir 105 is formed using a glass plate having a coefficient of thermal expansion of $8\times10^{-6}/°$ C. For forming the liquid jet port 500, anisotropic etching is employed as in the 12th embodiment.

What is characteristic in the liquid jetting apparatus of this embodiment, in addition to what is characteristic in the 12th embodiment, is the use, for the main plate forming the liquid reservoir 105, of a glass plate having a coefficient of thermal expansion that is intermediate between that of the monocrystalline lithium niobate plate 102 and the silicon plate 503. In this way, the same benefits are realized as in the ninth embodiment, and, compared to the 11th, 12th, and 13th embodiments, the problems of thermal stress and residual stress described in connection with the ninth embodiment are resolved, thereby enabling characteristic degradation to be lessened and long useful life to be achieved.

Now, in the first through the 14th embodiments, monocrystalline lithium niobate was used for the piezoelectric material of the piezoelectric drive elements, but the same benefits can be obtained using such piezoelectric materials as monocrystalline lithium tantalate, potassium niobate, or lead tantalate zirconate lanthanate. For the holding plate, moreover, one may use a silicon plate, glass plate, or the same type of material as the piezoelectric body, according to the application in view. Furthermore, in view of the merit of miniaturizing the liquid jetting apparatus, it is desirable that it be integrated with the circuit elements. As to the technique employed for doing this, silicon plates in which circuit elements have been formed may be used for the holding plate, as discussed in connection with the sixth embodiment. Alternatively, separately fabricated IC chips in which circuit elements are implemented may be directly bonded to the holding plate, or secured by some other technique.

According to the present invention, since no adhesive material is used, but the direct bonding is used particularly between the concave casing (holding plate) and piezoelectric drive element, i.e., between items 104 and 108, between items 104 and 118, between items 104 and 128, between 501 and 108, and between 504 and 108, the following advantages are observed.

(a) Since no adhesive material will melt into the ink, the quality of the ink will not be reduced.

(b) Since no adhesive particles will be mixed into the ink, the jet port 107 will not be choked by such adhesive particles.

(c) Since no excessive adhesive material intrude into the liquid reservoir, the capacity of the liquid reservoir can be maintained at the required volume with high accuracy.

(d) Since no adhesive material is exposed in the liquid reservoir, less bubble will be caught in the liquid reservoir. Many adhesive materials are water-resistant.

(e) Since the liquid reservoir can be concealed with higher preciseness, the pressure loss can be improved.

(f) Since the bonding strength of the direct bonding is stronger than the adhesive material and the durability is long, long life liquid jetting apparatus can be realized. The pressure inside the liquid reservoir becomes high, so that the fatigue at the adhesive bonded section becomes serious after a long term use. Almost no fatigue is observed when the direct bonding is used.

The above advantages are observed when the direct bonding is used between the concave casing 144 and the plate 145.

As described in the foregoing, the present invention is a liquid jetting apparatus that provides many benefits, making it possible tc, reduce the particle size of the liquid jetted to the micron order (small dot diameters), implement precision control of the liquid jet volume (dot diameter control), enhance liquid jet volume reproducibility (dot reproducibility), jet liquid intermittently at short intervals (high-speed jetting), increase the number of nozzles provided in the apparatus (multiple nozzle implementation), and provide these features in an inexpensive apparatus having long useful life. By using the liquid jetting apparatus of the present invention, moreover, high-resolution, multi-gradation, high-speed printing can be achieved at low cost.

What is claimed is:

1. A liquid jetting apparatus comprising:

a concave casing having an open flat face;

a piezoelectric drive element directly bonded to said open flat face of said concave casing so as to form an interatomic bond between atoms of said open flat face and atoms of said piezoelectric drive element such that hydroxyl groups on said open flat face form a hydrogen bond with hydroxyl groups on said piezoelectric drive element; and a liquid reservoir for storing a liquid, said liquid reservoir being formed between said concave casing and said piezoelectric drive element, said liquid reservoir having a liquid injection port for allowing a liquid to be injected into said liquid reservoir and having a liquid jet port for allowing stored liquid to be jetted from said liquid reservoir.

2. The apparatus of claim 1, wherein said piezoelectric drive element includes a first piezoelectric plate and a second piezoelectric plate directly bonded together so as to form an interatomic bond between atoms of said first piezoelectric plate and atoms of said second piezoelectric plate.

3. The apparatus of claim 1, wherein said piezoelectric drive element comprises a bimorph element including a first piezoelectric plate and a second piezoelectric plate.

4. The apparatus of claim 3, wherein said first piezoelectric plate and said second piezoelectric plate are directly bonded together so as to have opposite polarization directions and so as to form an interatomic bond between atoms of said first piezoelectric plate and atoms of said second piezoelectric plate.

5. The apparatus of claim 3, further comprising an electrically conductive center plate between said first piezoelectric plate and said second piezoelectric plate, said first piezoelectric plate and said second piezoelectric plate being directly bonded to said center plate so as to form an interatomic bond between atoms of said first piezoelectric plate and atoms of said center plate, and so as to form an interatomic bond between atoms of said center plate and atoms of said second piezoelectric plate.

6. The apparatus of claim 5, wherein said center plate is formed of a material selected from a group consisting of silicon, gallium-arsenic, and indium-phosphorus.

7. The apparatus of claim 1, wherein said piezoelectric drive element comprises a monomorph element including a piezoelectric plate and a substrate supporting said piezoelectric plate, said substrate being directly bonded to said open flat face of said concave casing.

8. The apparatus of claim 7, wherein said substrate comprises an electrode for applying voltage to said piezoelectric plate.

9. The apparatus of claim 1, wherein said piezoelectric drive element is formed of a material selected from a group consisting of monocrystalline lithium niobate, monocrystalline lithium tantalate, monocrystalline potassium niobate, and lead titanate lanthanate zirconate.

10. The apparatus of claim 1, wherein said concave casing is formed of silicon.

11. The apparatus of claim 1, further comprising an electric circuit formed on said concave casing.

12. The apparatus of claim 1, wherein said concave casing; is formed as a single integral unit.

13. The apparatus of claim 1, wherein said concave casing comprises a base plate and a side frame plate directly bonded onto said base plate.

14. The apparatus of claim 1, wherein said concave casing is formed of glass.

15. A liquid jetting apparatus comprising:

a concave casing having a bottom face and an open flat face;

a support plate directly bonded to said open flat face of said concave casing so as to form an interatomic bond between atoms of said open flat face and atoms of said support plate;

a liquid reservoir for storing a liquid, said liquid reservoir being formed between said concave casing and said support plate, said liquid reservoir having a liquid injection port for allowing a liquid to be injected into said liquid reservoir and having a liquid jet port for allowing stored liquid to be jetted from said liquid reservoir;

a piezoelectric drive element directly bonded to said bottom face so as to form an interatomic bond between atoms of said bottom face and atoms of said piezoelectric drive element such that hydroxyl groups on said bottom face form a hydrogen bond with hydroxyl groups on said piezoelectric drive element.

16. The apparatus of claim 15, wherein said piezoelectric drive element is formed of a material selected from a group consisting of monocrystalline lithium niobate, monocrystalline lithium tantalate, monocrystalline potassium niobate, and lead titanate lanthanate zirconate.

17. The apparatus of claim 15, wherein said concave casing is formed of silicon.

18. The apparatus of claim 15, further comprising an electric circuit formed on said concave casing.

19. The apparatus of claim 15, wherein said concave casing is formed of glass.

* * * * *